US010106958B2

(12) United States Patent
Matsumiya et al.

(10) Patent No.: US 10,106,958 B2
(45) Date of Patent: Oct. 23, 2018

(54) WORKING MACHINE

(71) Applicant: KUBOTA CORPORATION, Osaka-shi (JP)

(72) Inventors: Daisuke Matsumiya, Sakai (JP); Kiyoshi Matsui, Sakai (JP); Teruo Kunizawa, Sakai (JP); Fukusui Rin, Sakai (JP); Shigeru Kobayashi, Sakai (JP); Koji Nagahama, Sakai (JP); Yuji Kawano, Sakai (JP); Tsukasa Haraguchi, Sakai (JP)

(73) Assignee: KUBOTA CORPORATION, Osaka-Shi (JP)

( * ) Notice: Subject to any disclaimer, the term of this patent is extended or adjusted under 35 U.S.C. 154(b) by 256 days.

(21) Appl. No.: 14/987,764

(22) Filed: Jan. 5, 2016

(65) Prior Publication Data

US 2016/0289924 A1 Oct. 6, 2016

(30) Foreign Application Priority Data

Mar. 30, 2015 (JP) ..... 2015-069935
Mar. 30, 2015 (JP) ..... 2015-069936

(51) Int. Cl.
*E02F 9/20* (2006.01)
*E02F 9/22* (2006.01)
(Continued)

(52) U.S. Cl.
CPC ..... *E02F 9/2267* (2013.01); *E02F 9/0875* (2013.01); *E02F 9/0883* (2013.01);
(Continued)

(58) Field of Classification Search
CPC ..... E02F 9/0875; E02F 9/2012; E02F 9/2267; E02F 9/2275; E02F 9/2285
See application file for complete search history.

(56) References Cited

U.S. PATENT DOCUMENTS 3,329,232 A * 7/1967 Salna ..... B60P 1/50 172/813
7,854,284 B2 * 12/2010 Wada ..... E02F 9/121 180/327
(Continued)

FOREIGN PATENT DOCUMENTS

JP 2000-291065 10/2000
JP 2002227249 A * 8/2002 ..... E02F 9/2012
(Continued)

OTHER PUBLICATIONS

JP 2002227249 A machine translation to English from espacenet. 2002.*
(Continued)

*Primary Examiner* — F. Daniel Lopez
*Assistant Examiner* — Michael Quandt
(74) *Attorney, Agent, or Firm* — Mori & Ward, LLP

(57) ABSTRACT

A working machine includes a machine body, an operation fluid tank mounted on the machine body, a hydraulic device to be operated by an operation fluid supplied from the operation fluid tank. A valve unit includes a plurality of control valves to control the hydraulic device. The control valves are arranged along a horizontal direction. A switch valve is to be connected to the control valves. A first tube member includes a first fluid tube to connect the control valve and the switch valve to each other and supports the switch valve above the control valve.

17 Claims, 17 Drawing Sheets

(51) Int. Cl.
*E02F 9/08* (2006.01)
*F15B 13/08* (2006.01)

(52) U.S. Cl.
CPC ..... *E02F 9/2275* (2013.01); *E02F 9/2012* (2013.01); *F15B 13/0839* (2013.01); *F15B 13/0871* (2013.01); *F15B 13/0896* (2013.01); *F15B 2211/30595* (2013.01); *F15B 2211/611* (2013.01)

(56) References Cited

U.S. PATENT DOCUMENTS

| | | | | |
|---|---|---|---|---|
| 9,303,389 | B2 * | 4/2016 | Iwamoto | E02F 9/0875 |
| 2016/0146227 | A1 * | 5/2016 | Hoshaku | B62D 1/22 60/428 |

FOREIGN PATENT DOCUMENTS

| | | | | |
|---|---|---|---|---|
| JP | 2006-144456 | | 6/2006 | |
| JP | 2010106568 | A * | 5/2010 | E02F 3/325 |
| JP | 2012017553 | A * | 1/2012 | |
| JP | 2014-198936 | | 10/2014 | |

OTHER PUBLICATIONS

JP 2010106568 A machine translation to English from espacenet. 2010.*
JP 2012017553 A machine translation to English from espacenet. 2012.*

* cited by examiner

WORKING MACHINE

CROSS-REFERENCE TO RELATED APPLICATIONS

The present application claims priority under 35 U.S.C. § 119 to Japanese Patent Application No. 2015-069935, filed Mar. 30, 2015 and to Japanese Patent Application No. 2015-069936, filed Mar. 30, 2015. The contents of these applications are incorporated herein by reference in their entirety.

BACKGROUND OF THE INVENTION

Field of the Invention

The present invention relates to a working machine.

Discussion of the Background

Japanese Unexamined Patent Application Publication No. 2014-198936 discloses a working machine. The working machine disclosed in the publication is previously known as a backhoe. The working machine disclosed in Japanese Unexamined Patent Application Publication No. 2014-198936 arranges a hydraulic tank (a hydraulic operation fluid tank), a hydraulic motor, a control valve, a switch valve (an operation mode switch valve), and the like on a turn base (a device frame). The switch valve is what is called a third line valve, and is configured to return a hydraulic operation fluid (a hydraulic operation oil) to the hydraulic tank due to a switching operation without supplying the hydraulic operation fluid to the control valve.

The working machine disclosed in Japanese Unexamined Patent Application Publication No. 2006-144456 arranges a hydraulic tank (a hydraulic operation fluid tank), a fuel tank, a battery, and the like on a turn base, and arranges a valve unit laid longitudinally along a front to rear direction above the battery. The valve unit is configured of: a first block and a second block each configured of a plurality of control valves, the control valves being continuously connected along the front to rear direction; and a valve body formed to be larger than the first block and the second block in a vertical direction. The valve body is connected to a rear portion of the first block, and the second block is connected to a rear portion of the valve body. An attachment bracket is arranged on a front lower portion of the first block and on a rear lower portion of the second block.

SUMMARY OF THE INVENTION

According to one aspect of the present invention, a working machine includes a machine body, an operation fluid tank mounted on the machine body, a hydraulic device to be operated by an operation fluid supplied from the operation fluid tank. A valve unit includes a plurality of control valves to control the hydraulic device. The control valves are arranged along a horizontal direction. A switch valve is configured to be connected to the control valves. A first tube member includes a first fluid tube to connect the control valve and the switch valve to each other and supports the switch valve above the control valve.

According to another aspect of the present invention, a working machine includes a machine body, an operation fluid tank disposed on the machine body, a hydraulic device to be operated by an operation fluid supplied from the operation fluid tank, a valve unit which includes a plurality of control valves to control the operation of the hydraulic device, and a hydraulic tube to be connected to the control valves. The control valves are arranged in parallel along a horizontal direction. A first bracket is arranged on one side of the control valves along a direction of parallel alignment of the control valves. The first bracket is configured to form a space for arranging the hydraulic tube under the control valves. A second bracket is arranged on the other side of the control valves along the direction of parallel alignment of the control valves. The second bracket is configured to form the space together with the first bracket and is arranged diagonally to the first bracket.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
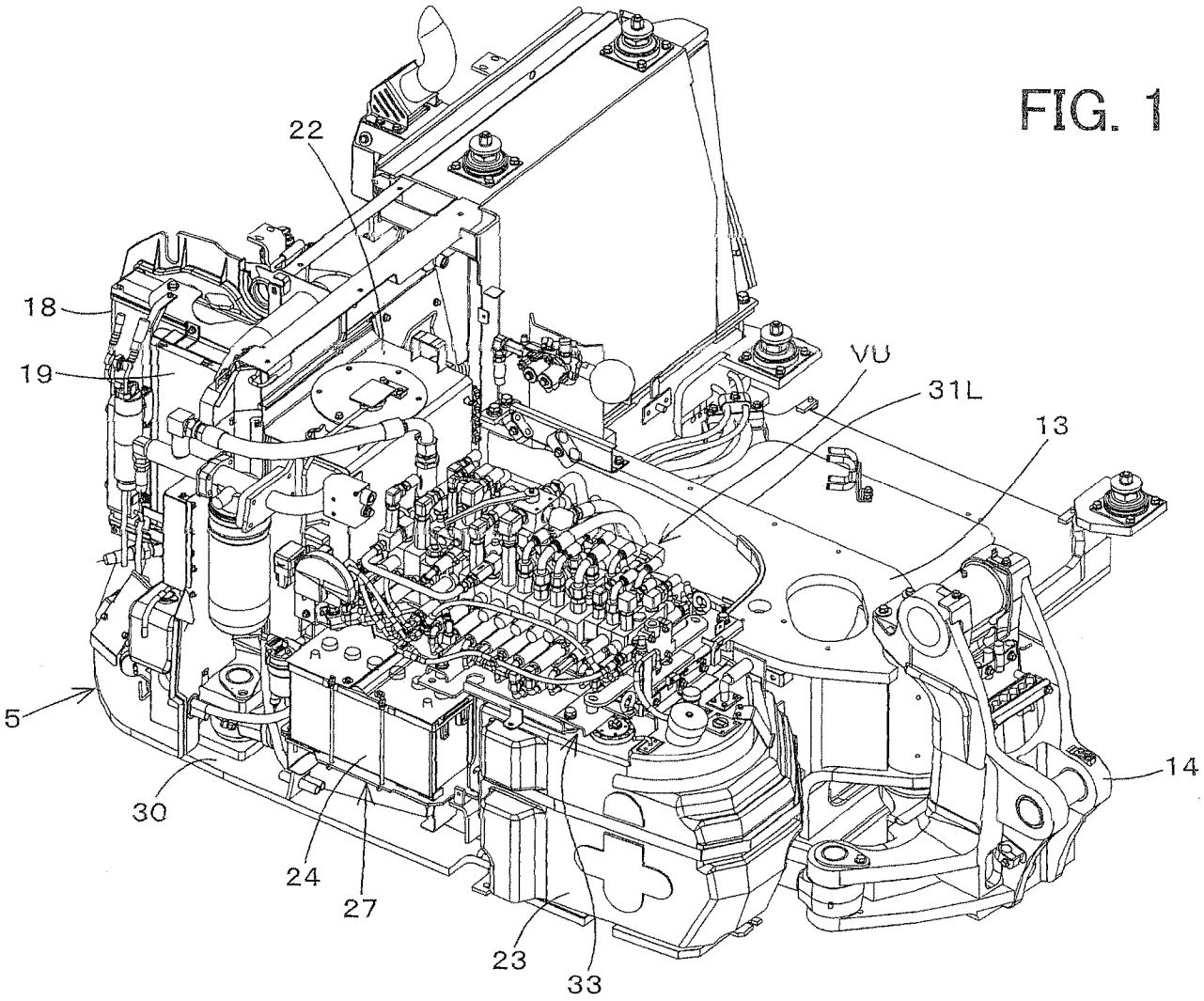
FIG. 1 is a perspective view showing a turn base according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

First Embodiment

Figure 17:
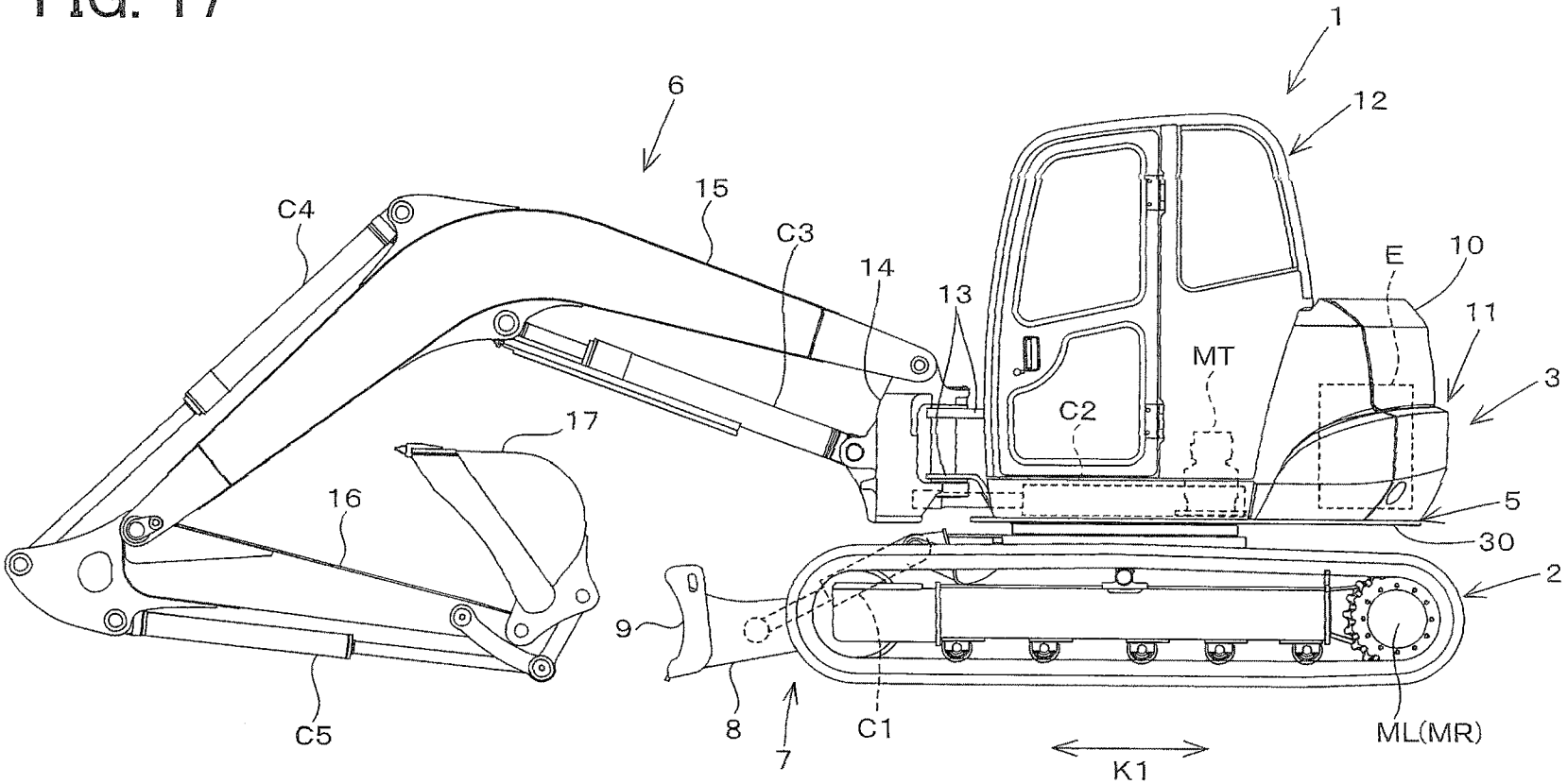
FIG. 17 is a side view showing all of the working machine according to the embodiments of the present invention.

FIG. 17 is a schematic view showing a whole configuration of a working machine 1 according to a first embodiment of the present invention, and exemplifies a backhoe of a swiveling working machine.

The working machine 1 includes a travel device 2 and a machine body (a turn body (a swiveling body)) 3. The travel device 2 is disposed on a lower portion of the working machine 1. The machine body 3 is disposed on an upper portion of the working machine 1.

Figure 16:
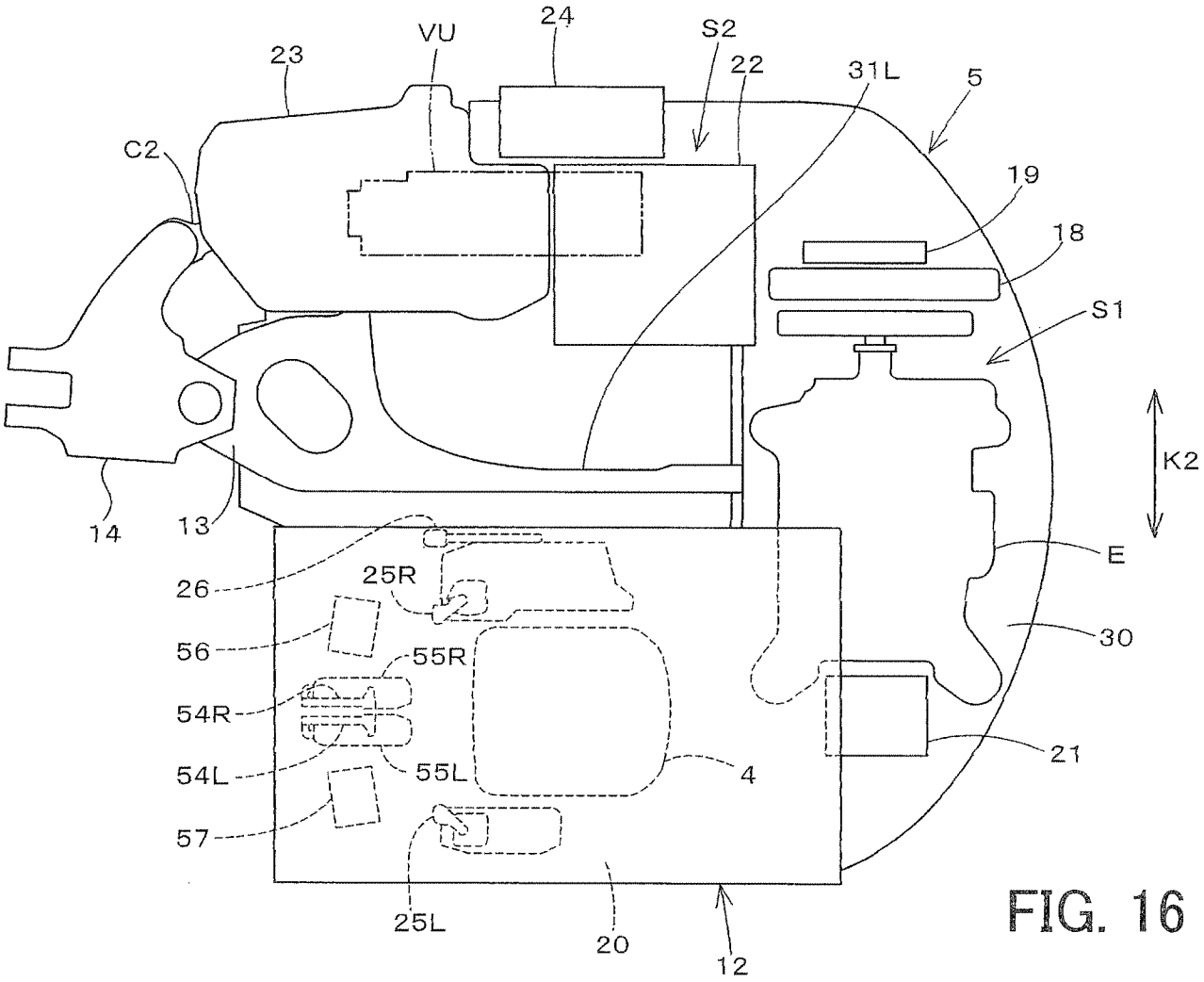
FIG. 16 is a plan view showing a turn base according to the second embodiment.

A cabin 12 is mounted on the machine body 3. As shown in FIG. 16, an operator seat 4 is disposed inside the cabin 12. Hereinafter, in explanations of the embodiment of the present invention, a forward direction (a direction shown by an arrowed line F in FIG. 17) corresponds to a front side of an operator seating on an operator seat 4 of the working machine 1, a backward direction (a direction shown by an arrowed line B in FIG. 17) corresponds to a back side of the operator, a leftward direction (a direction vertically extending from a back surface to a front surface of FIG. 17) corresponds to a left side of the operator, and a rightward direction (a direction vertically extending from the front surface to the back surface of FIG. 17) corresponds to a right side of the operator. Additionally, in the following description, a horizontal direction K2 (refer to FIG. 16) is a machine width direction, the horizontal direction K2 being perpendicular to a front to rear direction (a rear to front direction) K1. Moreover, in the following description, a direction from a center portion of the machine body 2 toward the above mentioned right side can be referred to as an outward direction. And, a direction from the center portion of the machine body 2 toward the above mentioned left side can be also referred to as the outward direction. The outward direction is hereinafter referred to as a machine outward direction. In other words, the machine outward direction corresponds to a direction departing from the center portion of the machine body 2 in the machine width direction. A direction opposite to the machine outward direction can be referred to as an inward direction. The inward direction is hereinafter referred to as a machine inward direction. In other words, the machine inward direction corresponds to a direction toward the center portion of the machine body 2 in the machine width direction.

The travel device 2 includes a pair of travel devices each having a crawler belt, one of the travel device is disposed on a right side of the machine body 3, and the other one of the travel device is disposed on a left side of the machine body 3. The travel device 2 disposed on the left side is driven by a travel motor ML disposed on the left side. The travel device 2 disposed on the right side is driven by a travel motor MR disposed on the right side.

A dozer unit 7 is disposed on a front portion of the travel device 2. The dozer unit 7 includes a support arm 8, a blade 9, and a dozer cylinder C1. The dozer cylinder C1 is connected to a front portion of the travel device 2 and to the support arm 8. The blade 9 is attached to a front portion of the support arm 8. Stretching and shortening of the dozer cylinder C1 allows the dozer unit 7 to lift and lower the support arm 8 and the blade 9.

The machine body 3 includes a turn base 5. The turn base 5 is supported on the travel device 2 by a turn bearing, and is capable of freely turning about a vertical axis of the turn bearing. The turn base 5 is turned by a turn motor MT. A rear portion of the turn base 5 is covered with a bonnet (an engine hood) 10 from above. A right side of the turn base 5 is covered with a side cover 11 from above.

The cabin 12 is mounted on a left portion of the turn base 5. The turn base 5 includes a support bracket 13 on a front portion of the turn base 5, the front portion being slightly rightward from the center in the machine width direction. An excavation unit 6 is attached to the support bracket 13.

The excavation unit 6 includes a swing bracket 14, a boom 15, an arm 16, and a bucket 17. The swing bracket 14 is supported by the support bracket 13, and is capable of freely swinging about a vertical axis. A base portion of the boom 15 is pivotally attached to the swing bracket 14, and is capable of freely turning about a horizontal axis, and thus the boom 15 is supported to be freely swung upward and downward. The arm 16 is pivotally attached to a tip end side of the boom 15, and is capable of freely turning about a horizontal axis, and thus the arm 16 is supported to be freely swung forward and backward. The bucket 17 is disposed on a tip end side of the arm 16, and is capable of performing a shoveling movement and a dumping movement. The working machine 1 is configured to install an operation tool (hereinafter referred to as a hydraulic attachment) in addition to or instead of the bucket 17, the operation tool being configured to be driven by a fluid pressure (an of pressure). A hydraulic attachment such as A hydraulic breaker, a hydraulic crusher, an angle broom, an earth auger, a pallet fork, a sweeper, a mower, and a snow blower can be exemplified as the hydraulic attachment, for example.

The swing bracket 14 is configured to be freely swung by stretching and shortening of a swing cylinder C2, the swing cylinder C2 being disposed in the turn base 5. The boom 15 is configured to be freely swung by stretching and shortening of a boom cylinder C3, the boom cylinder C3 being disposed between the boom 15 and the swing bracket 14. The arm 16 is configured to be freely swung by stretching and shortening of an arm cylinder C4, the arm cylinder C4 being disposed between the arm 16 and the boom 15. The bucket 17 is configured to freely perform the shoveling movement and the dumping movement due to stretching and shortening of a bucket cylinder C5, the bucket cylinder C5 being disposed between the bucket 17 and the arm 16. Each of the dozer cylinder C1, the swing cylinder C2, the boom cylinder C3, the arm cylinder C4, and the bucket cylinder C5 is configured of a hydraulic cylinder (a hydraulic device).

Meanwhile, the boom 15 and the dozer unit 7 each may employ another configuration different from the configuration described above.

The boom 15 may employ a two-piece configuration. The two-piece configuration is a configuration where the boom 15 is configured of two members, a front boom and a rear boom and is capable of being bent at a joint portion disposed between the front boom and the rear boom. In the case of the two-piece configuration, a boom cylinder (referred to as a second boom cylinder) is additionally disposed in addition to the boom cylinder C3, the second boom cylinder being used for bending the boom 15 at the joint portion.

The dozer unit 7 may employ an A/D (Angle Dozer) configuration. The A/D configuration is a configuration enabling an angle movement (the swinging rightward and leftward) of the dozer unit 7. In the case of the A/D configuration, an angle cylinder is additionally disposed in addition to the dozer cylinder C1, the angle cylinder being used for the angle movement.

The turn base 5 includes a turn base plate 30 and a step 20. The turn base plate 30 is configured of a thick plate, the thick plate being coupled to a turn bearing. The step 20 is arranged above the turn base plate 30 at a certain clearance. The operator seat 4 is arranged on the step 20.

Figure 3:
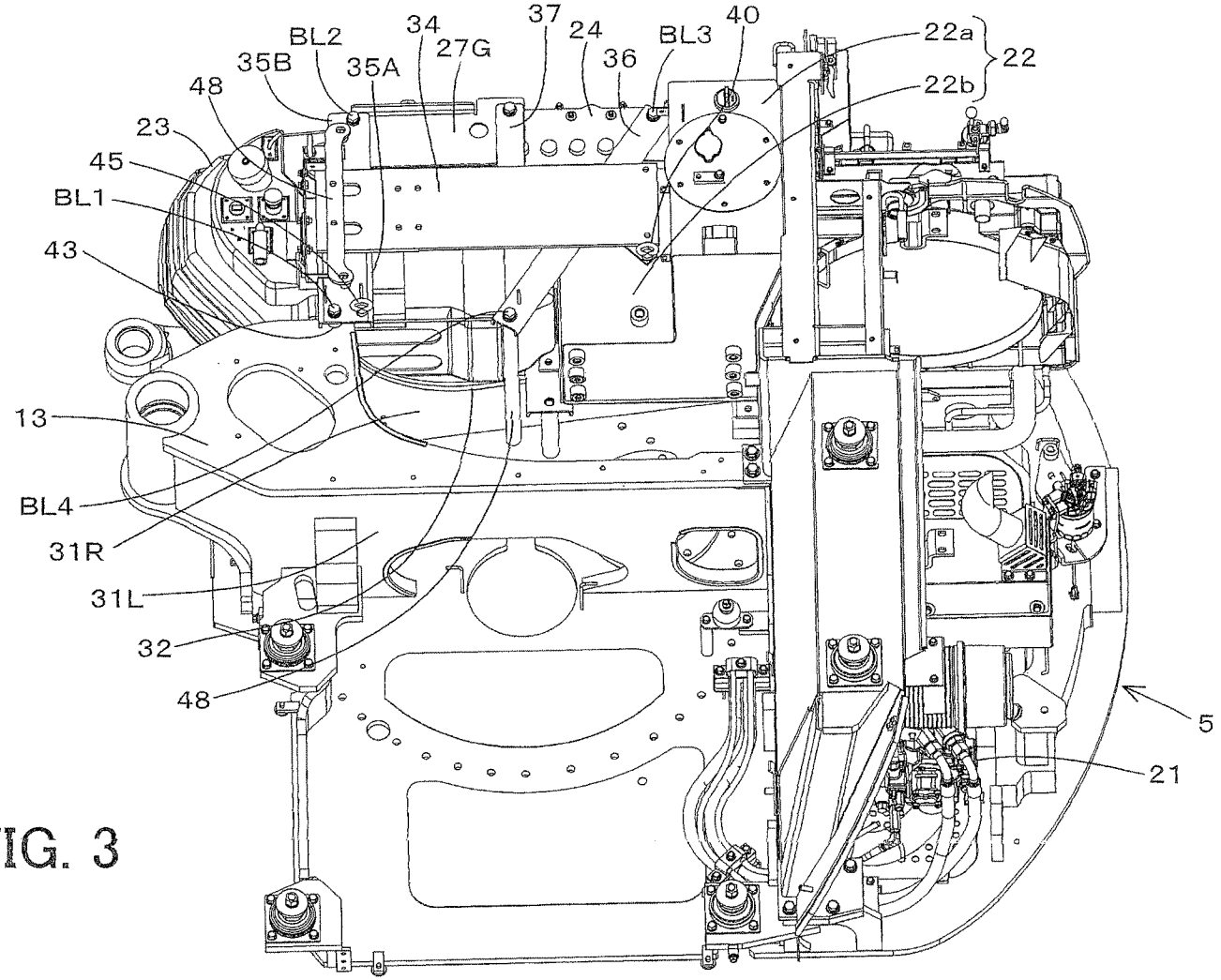
FIG. 3 is a view showing the turn base according to the first embodiment without showing the valve unit, being seen downwardly from above and leftward.

As shown in FIG. 3 and FIG. 16, a longitudinal rib 31R and a longitudinal rib 31L are disposed on the turn base plate 30, the longitudinal rib 31R being disposed on the right side, the longitudinal rib 31L being disposed on the left side. The longitudinal rib 31R and the longitudinal rib 31L are disposed on an approximately intermediate portion in the machine width direction, extending from a front portion to a rear portion. Front end portions of the longitudinal ribs 31R and 31L protrude forward from a front end portion of the turn base plate 30. The support bracket 13 is disposed between the front end portions of the longitudinal ribs 31R and 31L. The longitudinal rib 31L disposed on the left side extends on the turn base plate 30 along the front to rear direction, passing through a turn center of the machine body 3 toward the front to rear direction. The longitudinal rib 31R disposed on the right side extends from a portion in front of the turn base plate 30, the portion being slightly rightward in the machine width direction, diagonally rightward to the backward direction. The longitudinal rib 31R disposed on the right side includes a notch portion 32 behind the support bracket 13, the notch portion 32 being formed by downwardly notching an upper edge of the longitudinal rib 31R.

One end of the swing cylinder C2 is coupled to a slightly rightward front portion of the turn base plate 30. The other end of the swing cylinder C2 is coupled to the swing bracket 14.

As shown in FIG. 16, an engine room S1 and a tank room S2 are formed on the turn base 5. The engine room S1 is covered with the bonnet 10. The tank room S2 is covered with the side cover 11.

An engine E is arranged inside the engine room S1. The engine E is disposed on the turn base plate 30, and thus a crank shaft of the engine E extends toward the machine width direction. A radiator 18 is arranged on a right side of the engine E. An oil cooler (a fluid cooler) 19 is arranged on a right side of the radiator 18. A hydraulic pump 21 is arranged on a left side of the engine E. The hydraulic pump 21 is driven by the engine E. The hydraulic pump 21 includes a first pump and a second pump, the first pump being configured to supply an operation fluid for operating the hydraulic devices, the second pump being configured to supply a pilot fluid.

Figure 2:
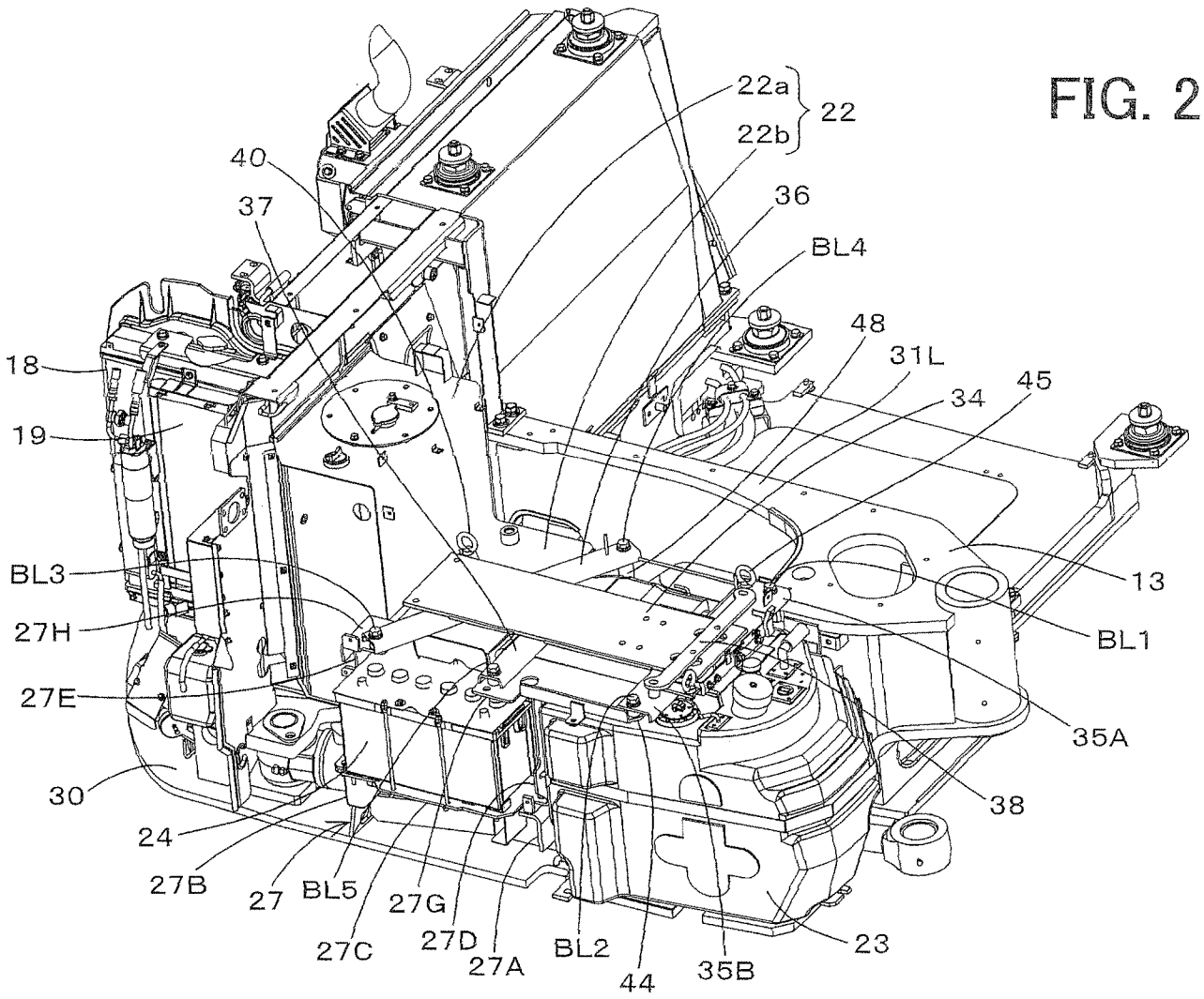
FIG. 2 is a view showing the turn base illustrated in FIG. 1 without showing a valve unit.

A operation fluid tank 22 is arranged in front of the radiator 18 and the oil cooler 19 inside the tank room S2. The operation fluid tank 22 stores the operation fluid supplied to the hydraulic devices. As shown in FIG. 2 and FIG. 3, the operation fluid tank 22 includes a main body portion 22*a* and an extension portion 22*b*, the main body portion 22*a* having a rectangular shape elongated in a vertical direction, the extension portion 22*b* extending forward from a front lower portion of the main body portion 22*a*, and thus the operation fluid tank 22 is formed to have an L-shape in a side view. A fuel tank 23 is arranged in front of the operation fluid tank 22. The fuel tank 23 stores fuel supplied to the engine E. A left portion of the operation fluid tank 22 and a left portion of the fuel tank 23 are positioned above the notch portion 32, the notch portion 32 being formed in the longitudinal rib 31R disposed on the right side.

A battery 24 is arranged on a right side of a front portion of the operation fluid tank 22 and on a right side of a rear portion of the fuel tank 23. A valve unit VU is arranged above the battery 24.

Figure 8:
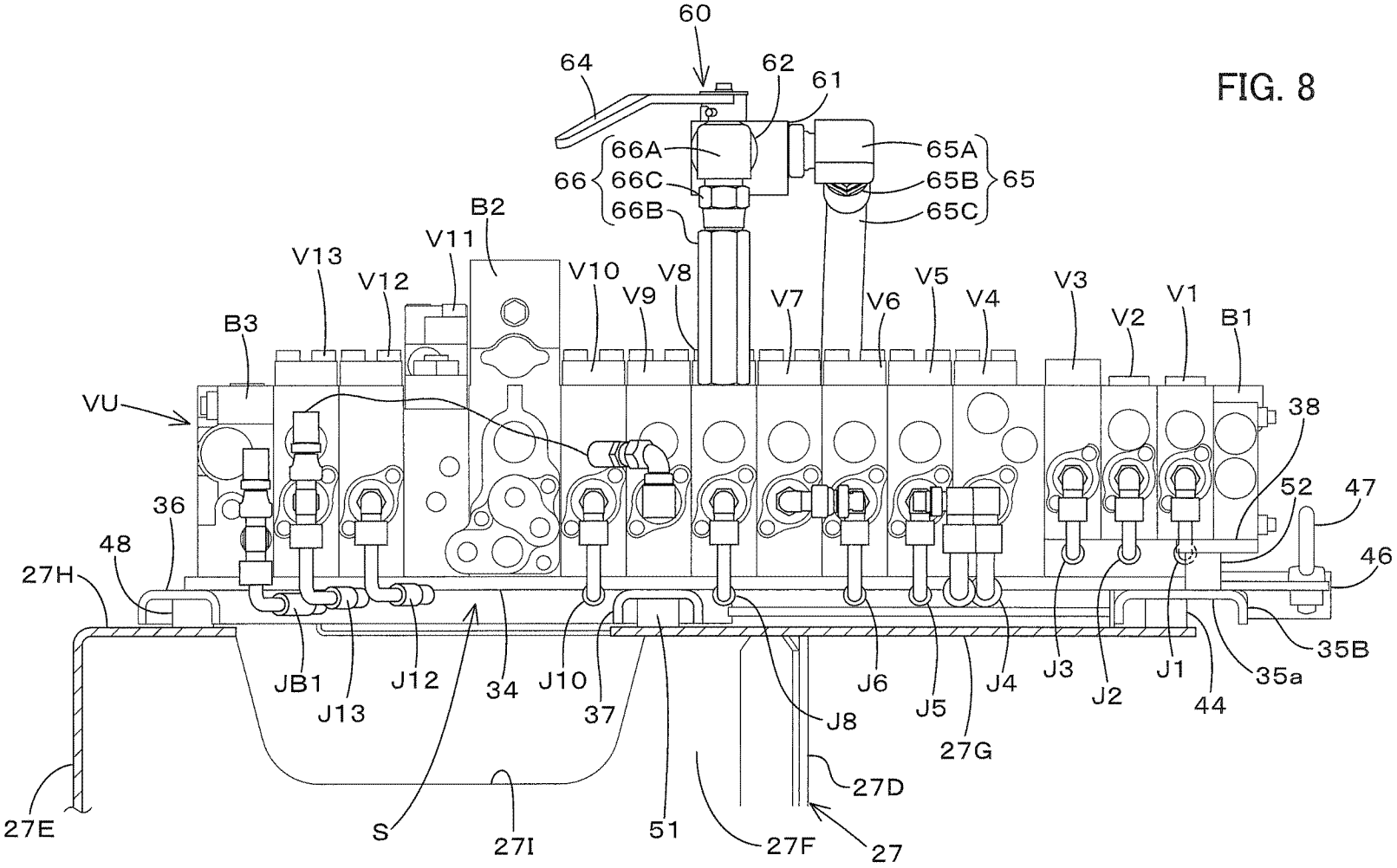
FIG. 8 is a view showing the support structure of the valve unit according to the first embodiment, being seen from left.
Figure 11:
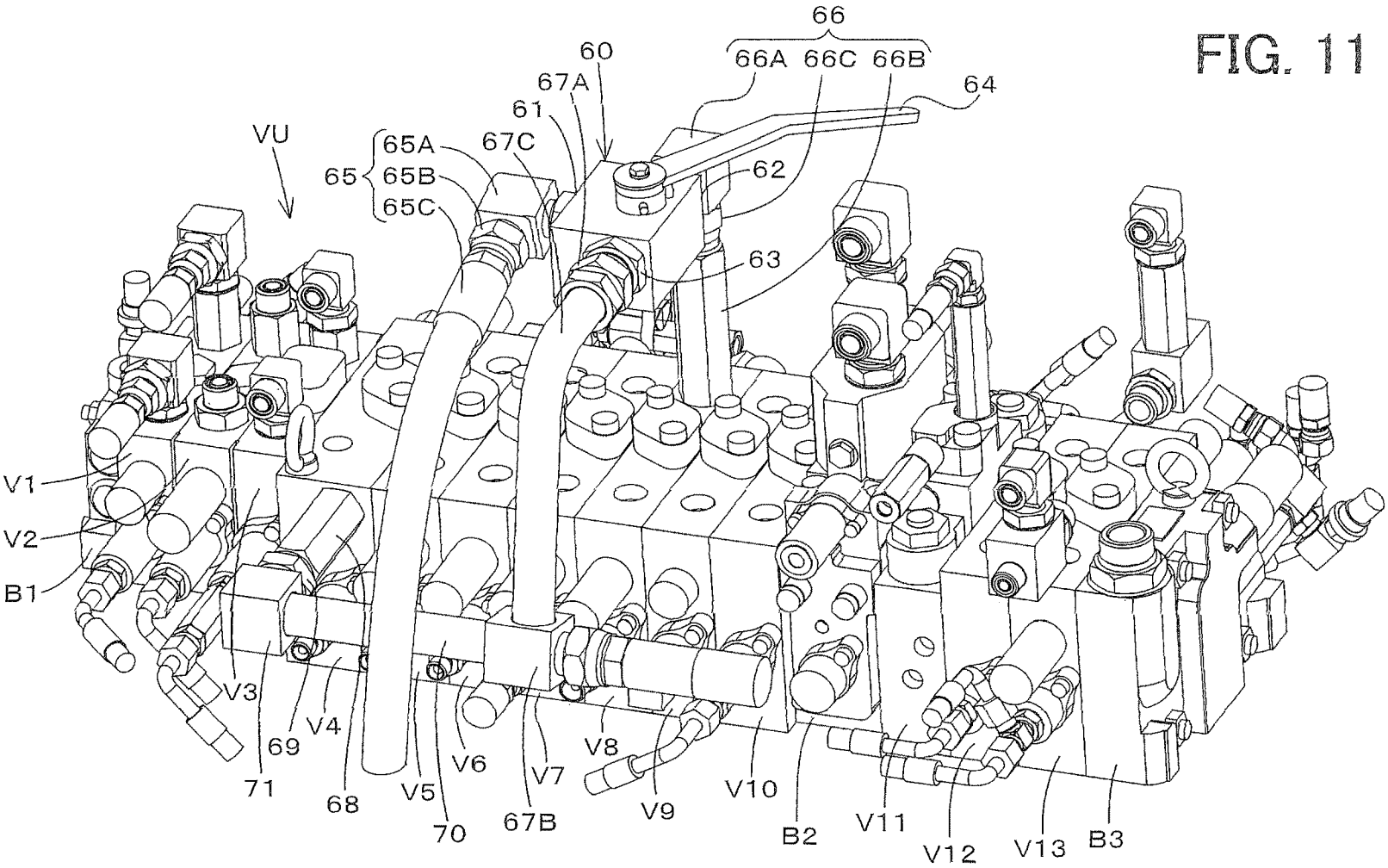
FIG. 11 is a perspective view showing the valve unit according to the first embodiment.
Figure 12:
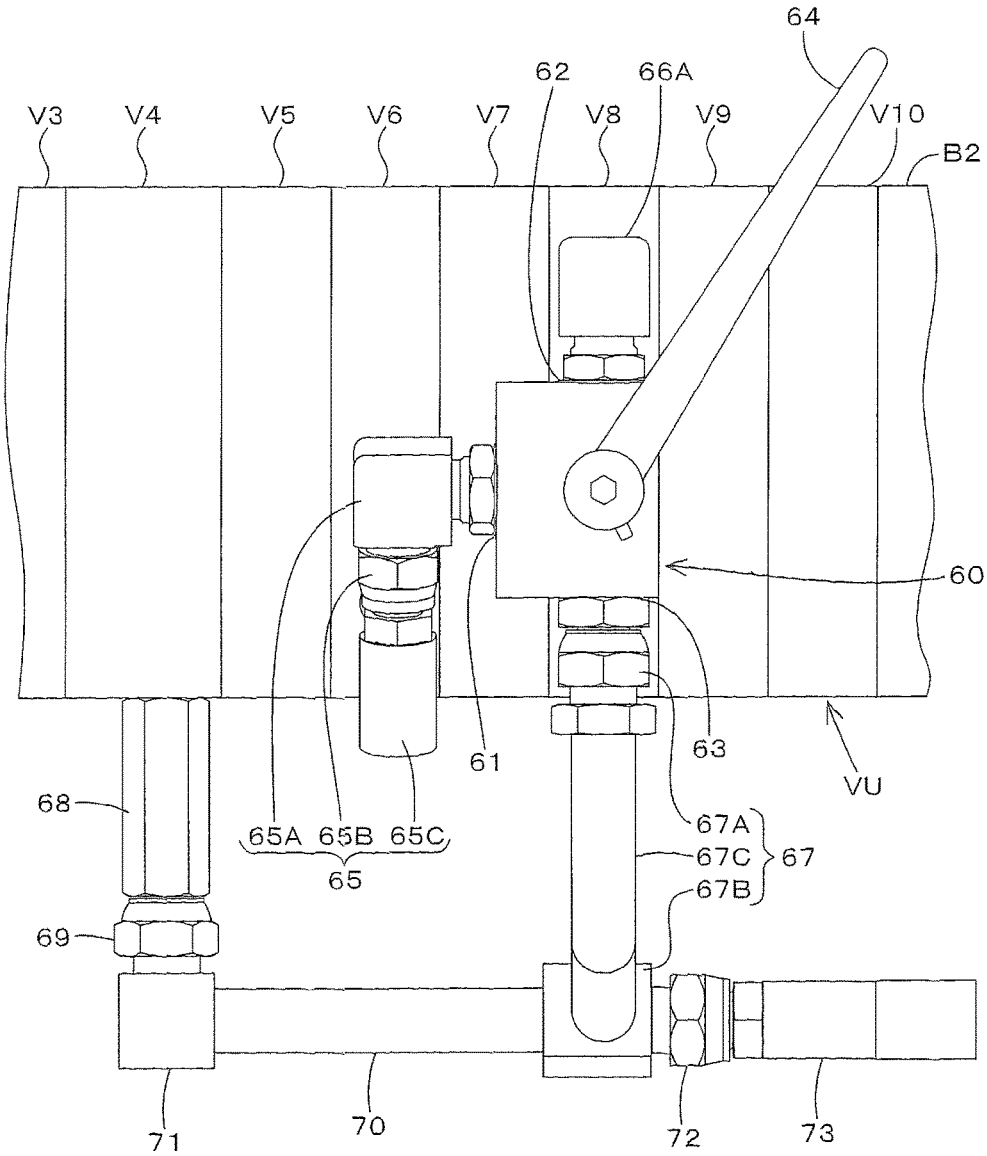
FIG. 12 is a plan view showing an area near a switch valve according to the first embodiment.

As shown in FIG. 8 and FIG. 11, the valve unit VU is configured by integrating control valves V1 to V13, an inlet block B2, a first outlet block B1, and a second outlet block B3. The control valves V1 to V13 are configured to control the operation fluid supplied to the hydraulic devices. The inlet block B2 is configured to receive a pressured fluid (a pressured oil). The first outlet block B1 and the second outlet block B2 are configured to discharge the pressured fluid. The control valves V1 to V13, the inlet block B2, and the first outlet block B1 and the second outlet block B2 are disposed being arranged along a horizontal direction. That is, the valve unit VU is arranged transversally. The control valves V1 to V13 are arranged along a direction perpendicular to a longitudinal direction (an operational direction of spools).

In the embodiment, the control valve V1 is a control valve for swing configured to control the swing cylinder C2. The control valve V2 is a first control valve for SP configured to control the hydraulic attachment. The control valve V3 is a control valve for turn configured to control the turn motor MT. The control valve V4 is a control valve for boom configured to control the boom cylinder C3. The control valve V5 is a control valve for two-piece configuration configured to control the second boom cylinder. The control valve V6 is a control valve for bucket configured to control the bucket cylinder C5. The control valve V7 is a control valve for arm configured to control the arm cylinder C4. The control valve V8 is a second control valve for SP configured to control the hydraulic attachment. The control valve V9 is a second control valve for dozer (a second dozer control valve) configured to control the dozer cylinder. The control valve V10 is a control valve for right traveling configured to control the travel motor MR of the travel device 5 disposed on the right side. The control valve V11 is a control valve for PPS/PLS configured to control a PPS (Pressure of Pump Sensing) signal pressure and a PLS (Pressure of Load Sensing) signal pressure. The control valve V12 is a control valve for left traveling configured to control the travel motor MR of the travel device 5 disposed on the left side. The control valve V13 is a first control valve for dozer (a first dozer control valve) configured to control the dozer cylinder.

In the embodiment, the first outlet block B1, the control valve V1 for swing, the first control valve V2 for SP, the control valve V3 for turn, the control valve V4 for boom, the control valve V5 for two-piece configuration, the control valve V6 for bucket, the control valve V7 for arm, the second control valve V8 for SP, the second control valve V9 for dozer, the control valve V10 for right traveling, the inlet block B2, the control valve V11 for PPS/PLS, the control valve V12 for left traveling, the first control valve V13 for dozer, and the second outlet block B3 are arranged from the front to the back in the order of appearance.

Meanwhile, the number of and a type of the control valves constituting the valve unit VU may be varied depending on a configuration of the working machine 1. The control valve V5 for two-piece is used for the two-piece configuration, and thus is not used for a standard configuration. In particular, the standard configuration is formed of arrays of the control valves, and the number of the arrays (the number of sections) is less by one than that in the two-piece configuration. In addition, the A/D configuration employs a control valve for A/D configuration instead of the control valve V5 for two-piece configuration, the control valve for A/D configuration being configured to control the angle cylinder.

Figure 4:
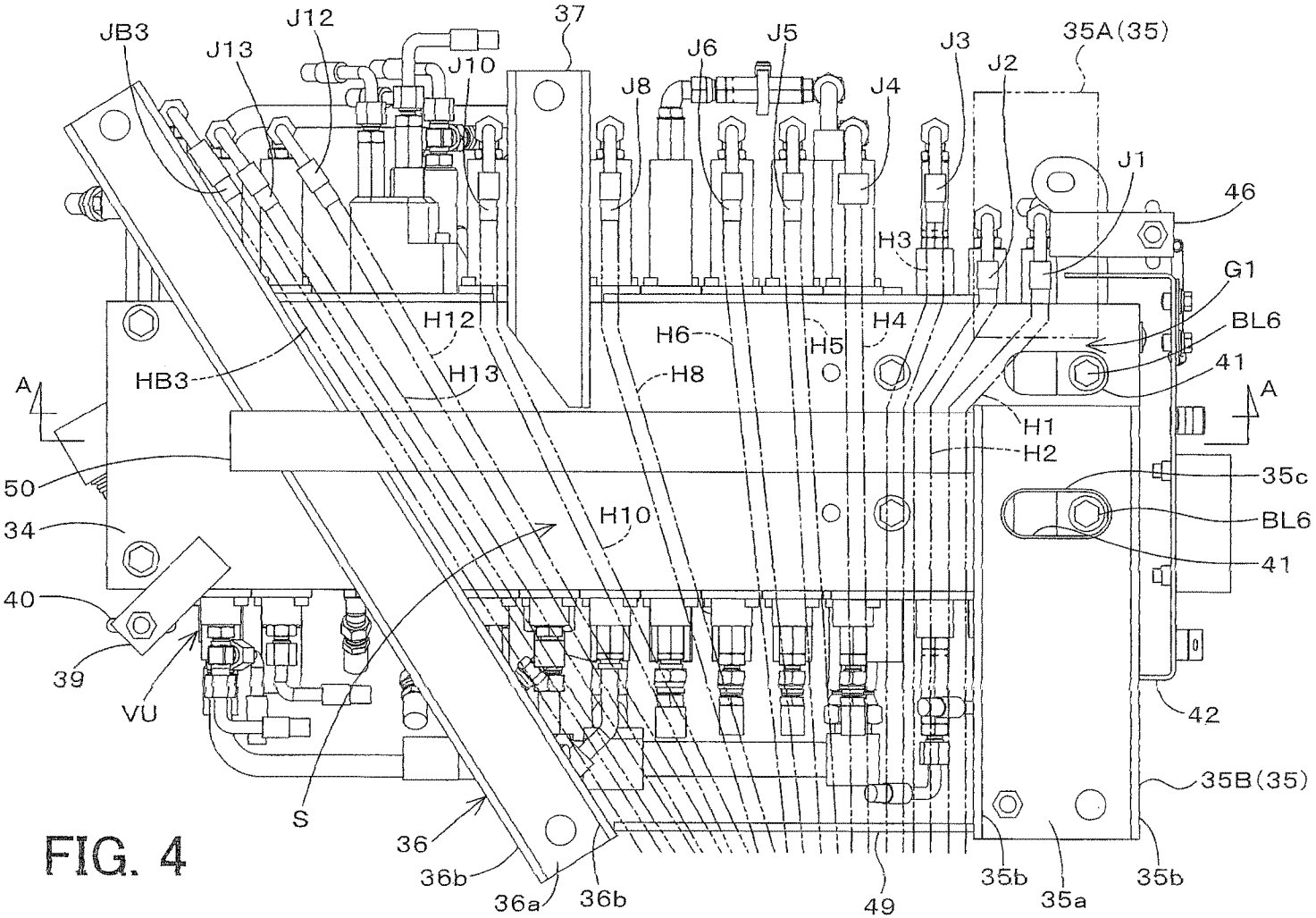
FIG. 4 is a view showing the turn base according to the first embodiment, being seen from below.

Each of the control valve V1 for swing, the first control valve V2 for SP, the control valve V3 for turn, the control valve V4 for boom, the control valve V5 for two-piece configuration, the control valve V6 for bucket, the second control valve V8 for SP, the control valve V10 for right traveling, the control valve V12 for left traveling, the first control valve V13 for dozer, and the second outlet block B3 is provided with a connection portion disposed on the machine outward direction (the right side). As shown in FIG. 4 and FIG. 8, each of connection tubes J1 to J6, J8, J10, J12, J13, and JB3 is connected to the corresponding connection portions, the connection tubes J1 to J6, J8, J10, J12, J13, and JB3 being used for connection to a pilot hose (a hydraulic hose for pilot pressure) serving as a hydraulic tube. Each of the connection tubes is bent downwardly from the corresponding connection portions, and is extended toward the machine inward direction (the left side) under the valve unit VU. The connection tubes 11 to J6, J8, and J10 extend in approximately parallel with the machine width direction under the valve unit VU. The connection tubes J12, J13, and JB3 extend in approximately parallel with a second bracket 36 described later under the valve unit VU, and thus the more closer to the machine inward, the more directly the connection tubes J12, J13, and JB3 extend toward the front.

As shown in FIG. 4, a pilot hose H1 is connected to the connection tube J1 connected to the control valve V1 for swing, the pilot hose H1 being used for connection to a pilot valve for swing. A pilot hose H2 is connected to the connection tube J2 connected to the first control valve V2 for SP, the pilot hose H2 being used for connection to a pilot valve for SP. A pilot hose H3 is connected to the connection tube J3 connected to the control valve V3 for turn, the pilot hose H3 being used for connection to a pilot valve for turn and arm. A pilot hose H4 is connected to the connection tube J4 connected to the control valve V4 for boom, the pilot hose H4 being used for connection to a pilot valve for boom and bucket. A pilot hose H5 is connected to the connection tube J5 connected to the control valve V5 for two-piece configuration, the pilot hose H5 being used for connection to the pilot valve for boom and bucket. A pilot hose H6 is connected to the connection tube J6 connected to the control valve V6 for bucket, the pilot hose H6 being used for connection to the pilot valve for boom and bucket. A pilot hose H8 is connected to the connection tube J8 connected to the second control valve V8 for SP, the pilot hose H8 being used for connection to the pilot valve for SP. A pilot hose H10 is connected to the control valve V10, the pilot hose H10 being used for connection to the pilot valve for traveling. A pilot hose H12 is connected to the control valve V12 for left traveling, the pilot hose H12 being used for connection to the pilot valve for traveling. A pilot hose H13 is connected to the first control valve V13 for dozer, the pilot hose H13 being used for connection to the pilot valve for dozer. The pilot hose HB3 is connected to the second outlet block B3.

As shown in FIG. 16, an operation lever 25R and an operation lever 25L are disposed on the right side of and the left side of the operator seat 4. Each of the operation lever 25R and 25L is connected to a pilot valve (not shown in the drawings) configured to be operated by corresponding one of the operation levers 25R and 25L.

The pilot valve attached to the operation lever 25L disposed on the left side is a pilot valve for turn and arm. The pilot valve for turn and arm is connected to the control valve V3 for turn and to the control valve V7 for arm by the pilot hoses H3 and H7. The pilot valve for turn and arm is operated by the operation lever 25L disposed on the left side, and thus operates the control valve V3 for turn and the control valve V7 for arm.

The pilot valve attached to the operation lever 25R disposed on the right side is a pilot valve for boom and bucket. The pilot valve for boom and bucket is connected to the control valve V4 for boom and to the control valve V6 for bucket by the pilot hoses H4 and H6. The pilot valve for boom and bucket is operated by the operation lever 25R disposed on the right side, and thus operates the control valve V4 for boom and the control valve V6 for bucket.

A dozer lever 26 is disposed on the right side of the operator seat 4. The dozer lever 26 is a lever for operating the dozer device 7. The dozer lever 26 is connected to a pilot valve for dozer configured to be operated by the lever. The pilot valve for dozer is connected to the first control valve V13 for dozer by the pilot hose H13.

Travel levers 54R and 54L, a swing pedal 56, and an SP pedal 57 are disposed in front of the operator seat 4. The travel lever 54R is a lever configured to operate the travel device 2 disposed on the right side. The travel lever 54L is a lever configured to operate the travel device 2 disposed on the left side. The swing pedal 56 is a pedal for operation of swinging the swing bracket 17. The SP pedal 57 is a pedal for operation of the hydraulic attachment attached instead of the bucket 20.

The travel levers 54R and 54L are arranged in front of the operator seat 4. The travel lever 54R and 54L are connected to the pilot valve for travel disposed under the step 20. The pilot valve for travel is connected to the control valve V10 for right traveling and to the control valve V12 for left traveling by the pilot hoses H10 and H12. The pilot valve for travel is operated by the travel levers 54R and 54L, and thus controls the control valve V10 for right traveling and the control valve V12 for left traveling. Travel pedals 55R and 55L are disposed in front of the operator seat 4, and thus the travel device 2 is configured to be operated by the travel pedals 55R and 55L.

The swing pedal 56 is arranged to the right of the travel levers 54R and 54L. The swing pedal 56 is connected to the pilot valve for swing disposed under the step 20. The pilot valve for swing is connected to the control valve V1 for swing by the pilot hose H1. The pilot valve for swing is operated by the swing pedal 56, and thus controls the control valve V1 for swing.

The SP pedal 57 is arranged to the left of the travel levers 54R and 54L. The SP pedal 57 is connected to the pilot valve for SP (not shown in the drawings) disposed under the step 20. The pilot valve for SP is connected to the first control valve V2 for SP and to the second control valve V8 for SP by the pilot hoses H2 and H8. The pilot valve for SP is operated by the SP pedal 57, and thus controls the first control valve V2 for SP and the second control valve V8 for SP.

As shown in FIG. 2, FIG. 8, and the like, the battery 24 is supported on the turn base plate 30 by a support base 27. The support base 27 includes a front leg portion 27A, a rear leg portion 27B, a lower plate portion 27C, a front plate portion 27D, a rear plate portion 27E, a back plate portion 27F, a front upper plate portion 27G, and a rear upper plate portion 27H. The front leg portion 27A and the rear leg portion 27B are arranged being separated to each other along the front to rear direction, and are fixed to an upper surface of the turn base plate 30 at lower end portions of the front leg portion 27A and the rear leg portion 27B. The lower plate portion 27C is a portion for installation of the battery 24, and is disposed between the front leg portion 27A and the rear leg portion 27B in parallel with the turn base plate 30. The front plate portion 27D is disposed above the front leg portion 27A in front of the battery 24. The rear plate portion 27E is disposed behind the battery 24 and above the rear leg portion 27B. The back plate portion 27F is disposed to the left of the battery 24 (on the machine inward), and is connected to left edges of the front plate portion 27D, the rear plate portion 27E, and the lower plate portion 27C, thereby linking the left edges each other. A notch 271 is formed in the back plate portion 27F, the notch 271 having an appropriately U-shape. The front upper plate portion 27G is fixed to an upper end portion of the front plate portion 27F and to an upper end portion of the back plate portion 27F, and extends toward the front direction of and the rear direction of the front plate portion 27F. The portion extending toward the front direction is positioned above the fuel tank 23, and the portion extending toward the rear direction is positioned above the battery 24. The rear upper plate portion 27H is bent at an upper end portion of the rear plate portion 27E, and is extended forward from the upper end portion, and thus the rear upper plate portion 27H is positioned above the battery 24.

As shown in FIG. 1 and FIG. 16, the valve unit VU is disposed on one side (the right side) in the width direction of the machine body 3. The valve unit VU is supported above the battery 24 by a support member 33. A front portion of the valve unit VU is positioned above the fuel tank 23. A rear portion of the valve unit VU is positioned above the extension portion 22*b* of the operation fluid tank 22.

The support member 33 includes a support plate 34, a first bracket 35, a second bracket 36, a third bracket 37, and a fourth bracket 38.

Figure 5:
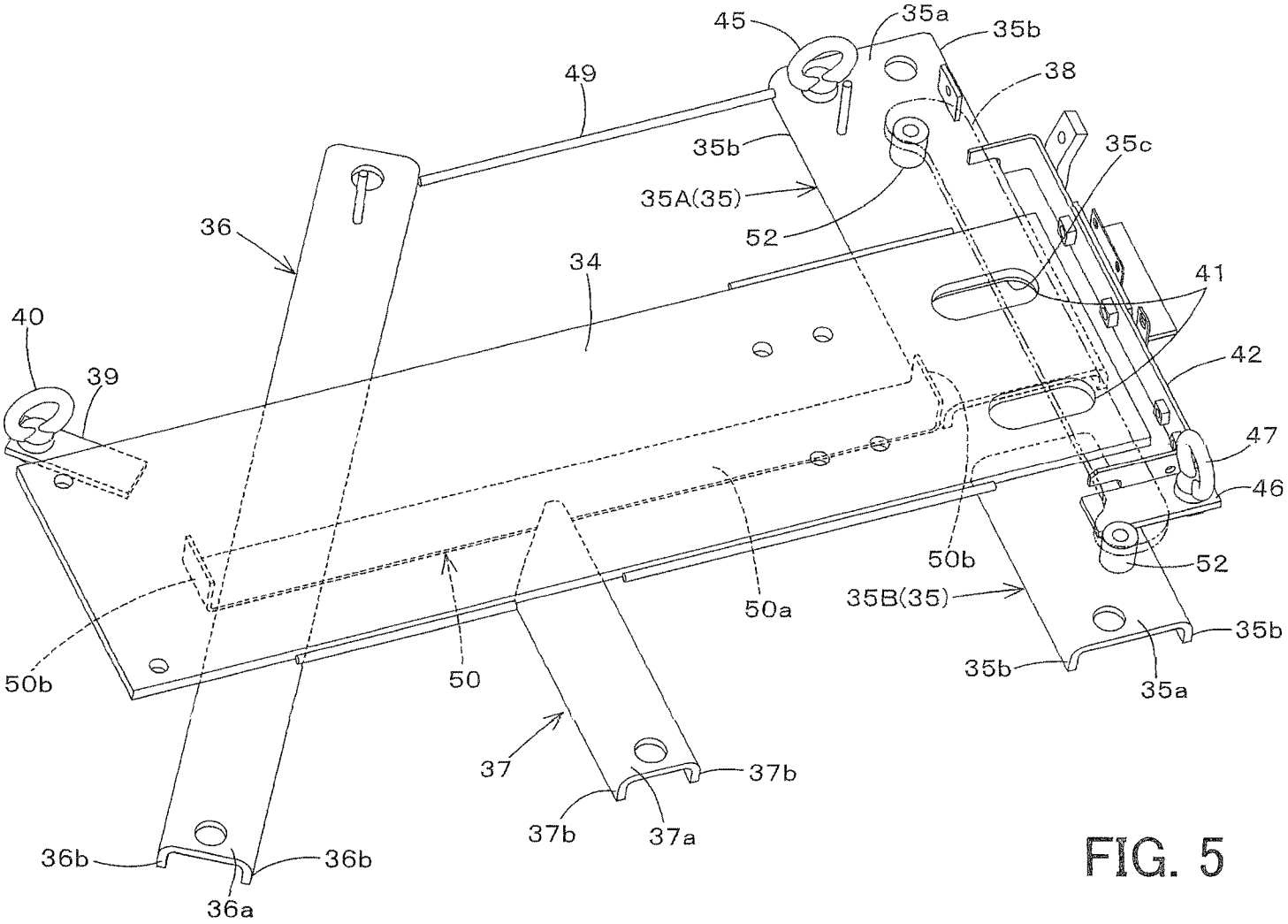
FIG. 5 is a downward perspective view showing a support structure of the valve unit according to the first embodiment.
Figure 6:
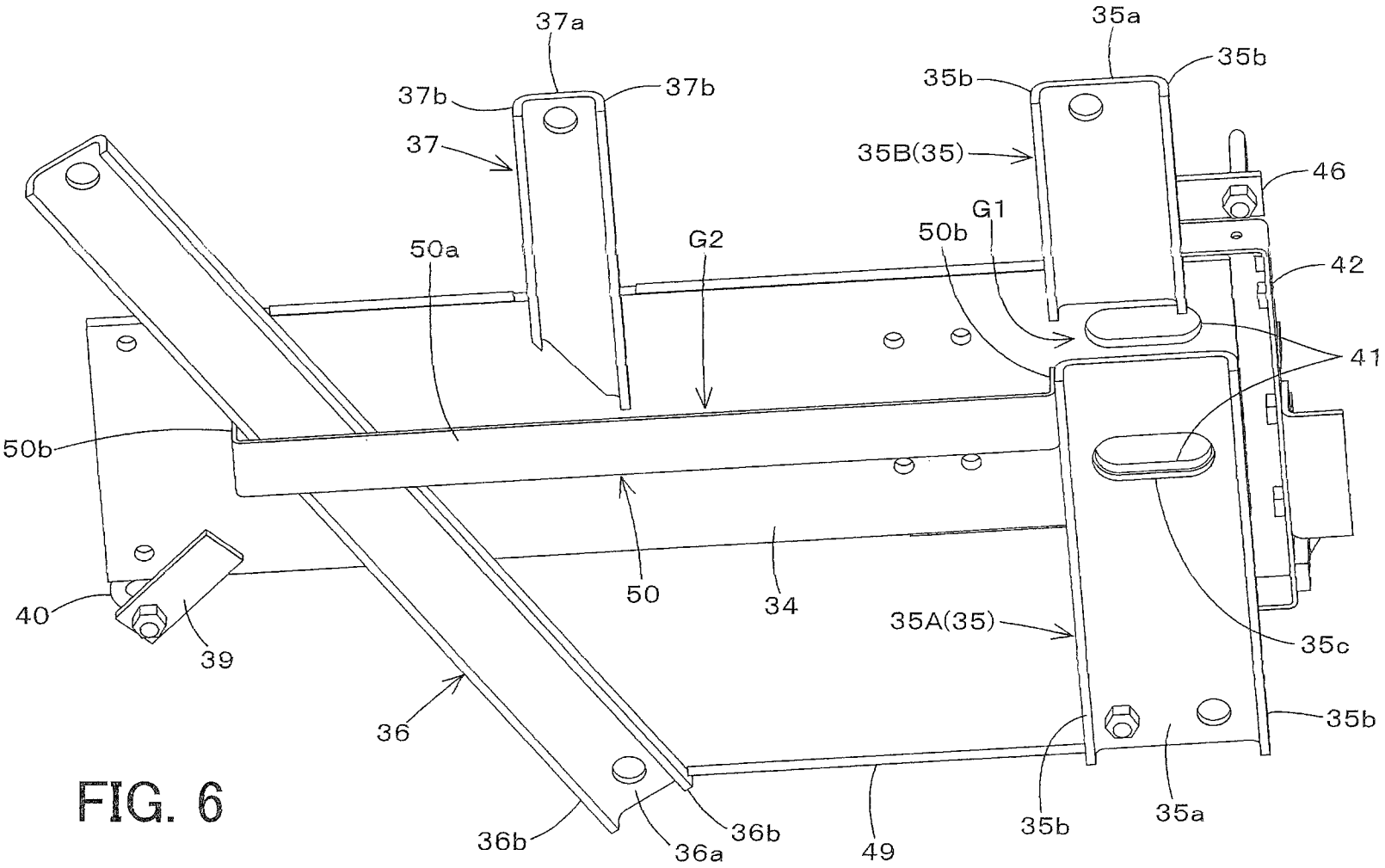
FIG. 6 is an upward perspective view showing a support structure for the valve unit according to the first embodiment.

As shown in FIG. 4, FIG. 8, and the like, the support plate 34 supports a lower surface of the valve unit VU. As shown in FIG. 2 to FIG. 6, the support plate 34 is a flat plate rectangular in a plan view, and is arranged extending a longer side of the support plate 34 along the front to rear direction and extending a shorter side thereof along the machine width direction. The support plate 34 and the valve unit VU are fixed by bolts. The support plate 34 is arranged on the extension portion 22*b* of the operation fluid tank 22, on a rear portion of the fuel tank 23, and above the battery 24, and thus the support plate 34 is arranged to the left (the machine inward) of the front upper plate portion 27G and rear upper plate portion 27H of the support base 27. As shown in FIG. 5 and FIG. 6, a first plate 39 is fixedly attached to a rear portion of a bottom surface of the support plate 34. The first plate 39 extends leftward and backward from the support plate 34, and is provided with a hanging metal tool 40 on a front surface of the first plate 39, the hanging metal tool 40 being configured of an eyebolt. In addition, a pair of elongate holes 41 are formed on a front portion of the support plate 34, the elongate holes 41 extending along the front to rear direction. The pair of elongate holes 41 are arranged side by side along the machine width direction. The elongate holes 41 are disposed under a first attachment hole 38A of a forth bracket 38 described below.

As shown in FIG. 4 to FIG. 6, FIG. 8, and the like, the first bracket 35, the second bracket 36, and the third bracket 37 support a lower surface of the support plate 34.

As shown in FIG. 4 to FIG. 6, the first bracket 35 includes: an inner bracket 35A positioned on a side of the machine inward; and an outer bracket 35B positioned on a side of the machine outward. The inner bracket 35A and the outer bracket 35B include a lateral plate portion 35*a* and a pair of longitudinal plate portions 35*b*. An upper surface of the lateral plate portion 35*a* is contacted to a lower surface of the support plate 34. The pair of longitudinal plate portions 35*b* each extend downward from both of corresponding one side edge of and the other side edge of the lateral plate portion 35*a*.

The inner bracket 35A and the outer bracket 35B extend toward a direction (the machine width direction) perpendicular to a direction of parallel alignment of the control valves V1 to V13, and are arranged at an interval of clearance G1 along the machine width direction. As shown in FIG. 6 and the like, the clearance G1 is disposed on a position corresponding to one of the elongate holes 41 (disposed on the machine inward side), the elongate hole 41 being formed on the support plate 34. The inner bracket 35A and the outer bracket 35B are connected to each other by a front connection member 42, the front connection member 42 being arranged in front of the corresponding brackets 35A and 35B.

The inner bracket 35A protrudes, from a left side edge of the support plate 34, an edge portion thereof disposed on the machine inward side (the left side), and arranges, under the support plate 34, an edge portion thereof disposed on the machine outward side (the right side). The outer bracket 35A places, under the support plate 34 and to the right of the inner bracket 35A, an edge portion thereof disposed on the machine inward side (the left side), and protrudes, from a right side edge of the support plate 34, an edge portion thereof disposed on the machine outward side (the right side).

As shown in FIG. 3, the edge portion of the inner bracket 35A, disposed on the machine inward side, is placed above a right portion of the support bracket 13 disposed on the front portion of the turn base 5, and is coupled to the support bracket 13 by a bolt BL1. A spacer 43 having a cylindrical shape is inserted between the inner bracket 35A and the support bracket 13.

As shown in FIG. 4 to FIG. 6, an elongate hole 35*c* is formed in the inner bracket 35A, the elongate hole 35*c* extending along the front to rear direction. The elongate hole 35*c* is disposed on a position corresponding to the other one of the elongate holes 41 (on the machine outward side), the elongate hole 41 being formed on the support plate 34.

As shown in FIG. 2 and FIG. 3, the edge portion of the outer bracket 35B, disposed on the machine outward side, is placed above a front portion of the front upper plate 27G of the support base 27, and is coupled to the front upper plate 27G by a bolt BL2. A spacer 44 having a cylindrical shape is inserted between the outer bracket 35B and the front upper plate 27G.

As shown in FIG. 5 and the like, a hanging metal tool 45 configured of an eyebolt is attached on the edge portion of the inner bracket 35A, the edge portion being disposed on the left side (the machine inward side). The inner bracket 35A is formed of rigid material to have the above mentioned form, and thus has high stiffness. The hanging metal tool 45 is attached to the inner bracket 35A (the first bracket) having high stiffness, and thereby the attachment portion of the hanging metal tool 45 is prevented from being broken when the hanging metal tool 45 hangs up the heavy valve unit VU. In addition, the attachment of the hanging metal tool 45 does not require an additional member for the attachment, and thus the number of components can be reduced and a total weight of the first bracket can be reduced. Moreover, the hanging metal tool 45 can be attached under a state where the valve unit VU is assembled on the first bracket 35, and thus an operation of assembly can be advantageously improved.

As shown in FIG. 5, FIG. 8, and the like, a second plate 46 is fixedly attached to an upper surface of the outer bracket 35B. The second plate 46 extends forward on a right side (the machine outward) of the support plate 34. A hanging metal tool 47 is attached on an upper surface of a front portion of the second plate 46.

As shown in FIG. 5, FIG. 6, and the like, the second bracket 36 includes: a lateral plate portion 36*a*; and a pair of longitudinal plate portions 36*b*. An upper surface of the lateral plate portion 36*a* is contacted to a lower surface of the support plate 34. The pair of longitudinal plate portions 36*b* each extend downward from both of corresponding one side edge of and the other side edge of the lateral plate portion 36*a*. The second bracket 36 is arranged diagonally with respect to the first bracket 35. In particular, the second bracket 36 is disposed extending diagonally to the perpendicular direction (the machine width direction). In more particular, the second bracket 36 is disposed extending diagonally, and thus the more closer to the machine inward, the more directly the second bracket 36 extends toward the front.

The second bracket 36 protrudes, from a right side edge of the support plate 34, an edge portion thereof disposed on the machine outward side (the right side), and protrudes, from a left side edge of the support plate 34, an edge portion thereof disposed on the machine inward side (the left side). As shown in FIG. 2, the edge portion of the second bracket 36, disposed on the machine outward side, is placed above the rear upper plate portion 27H of the support base 27, and is coupled to the rear upper plate portion 27H by a bolt BL3. As shown in FIG. 8, a spacer 48 having a cylindrical shape is inserted between the second bracket 36 and the rear upper plate portion 27H. As shown in FIG. 2 and FIG. 3, the edge portion of the second bracket 36, disposed on the machine inward side, is coupled to a support pole 48. The support pole 48 is fixed to the turn base 5 at a lower end portion of the support pole 48, and is fixed to the second bracket 36 at an upper end portion of the support pole 48. The support pole 48 is disposed vertically on the left side of the longitudinal rib 31R in front of the operation fluid tank 22. The second bracket 36 is disposed extending diagonally, and thus the more closer to the machine inward, the more directly the second bracket 36 extends toward the front. In this manner, the support pole 48 can be disposed vertically in front of the operation fluid tank 22, avoiding an intersection with the operation fluid tank 22.

The first bracket 35 is disposed on one side (the front side) in the direction of parallel alignment of the control valves V1 to V13. The second bracket 36 is disposed on the other side (the rear side) in the direction of parallel alignment of the control valves V1 to V13. In particular, the first bracket 35 and the second bracket 36 are arranged at an interval of clearance along the forward to rear direction in the direction of parallel alignment of the control valves V1 to V13.

The first bracket 35 and the second bracket 36 form a space S for arrangement of a hydraulic tube (the pilot hose) under the control valves. In particular, as shown in FIG. 8 and FIG. 4, the first bracket 35 and the second bracket 36 form the space S under the support plate 34 between the first bracket 35 and the second bracket 36. Accordingly, the pilot hoses H1 to H6, H8, 1110, H12, H13, and HB3 can be arranged being inserted through the space S, and thus the pilot hoses are not required to avoid the valve unit VU in the arrangement.

In addition, the second bracket 35 is arranged diagonally to the first bracket 35 as described above. In particular, the first bracket 35 is disposed extending toward the machine width direction, and the second bracket 36 is disposed extending diagonally, and thus the more closer to the machine inward, the more directly the second bracket 36 extends toward the front. In this manner, the more the first bracket 35 and the second bracket 36 extend toward the machine outward, the more the first bracket 35 and the second bracket 36 are widely apart from each other gradually, and thus the space S is enlarged gradually. A Width of the space S on an inner side in the width direction of the machine 3 is wider than a width of the space S on an outer side in the width direction, the widths being formed by the first bracket 35 and the second bracket 36. Accordingly, the plurality of pilot hoses H1 to H6, H8, H10, H12, H13, and HB3 can be easily arranged in the space S from the machine outward side (an outside in the width direction of the machine body) to the machine inward side (an inner side in the width direction of the machine body).

As shown in FIG. 4, the plurality of pilot hoses pass through the space S along the second bracket 36 and toward the machine inward, and thus the hoses can be aligned diagonally forward. That is, the second bracket 36 serves as a guide member for determining an extending direction of the pilot hoses. As the result, the plurality of pilot hoses passing through the space S are withdrawn diagonally forward on the machine inward, being closely adjacent to each other. In this manner, an operation for assembly connecting the plurality of pilot hoses to the pilot valves can be simplified, the pilot hoses being withdrawn from the space S.

As shown in FIG. 5, FIG. 6, and the like, the first bracket 35 and the second bracket 36 are connected to each other by a first connection member 49 and a second connection member 50.

The first connection member 49 connects a left edge portion of the first bracket 35 (a machine inward edge) to a left edge portion of the second bracket 36. The first connection member 49 is a rod member, and extends in the front to rear direction.

Figure 7:
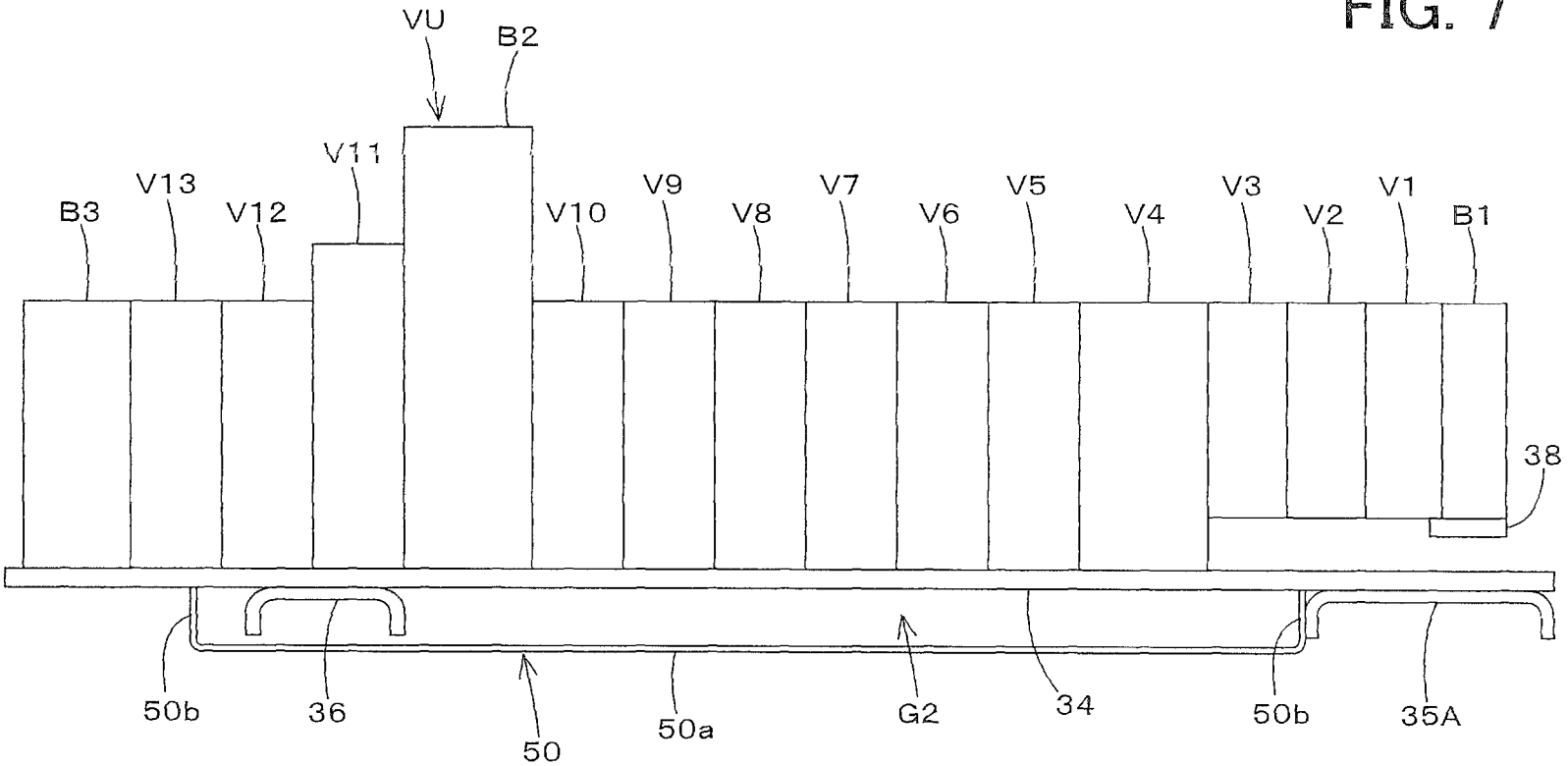
FIG. 7 is a view showing a cross section of A-A of FIG. 4.

The second connection member 50 connects between: an intermediate portion of the first bracket 35 in a length direction (an extending direction) of the first bracket 35; and an intermediate portion of the second bracket 36 in a length (an extending direction) of the second bracket 36. The second connection member 50 includes a lateral plate portion 50*a* and a pair of longitudinal plate portions 50*b*. As shown in FIG. 6 and FIG. 7, the lateral plate portion 50*a* is arranged under a lower surface of the support plate 34 at an interval of clearance G2 from the lower surface. The pair of longitudinal plate portions 50*b* each extend upward from a front edge portion of or a rear edge portion of the lateral plate portion 50*a*. One of the pair of longitudinal plate portions 50*b* is connected to the first bracket 35, and the other one of the pair of longitudinal plate portions 50*b* is connected to the second bracket 36. The pilot hoses H1 to H6, H8, H10, H12, H13, and HB3 can be arranged in the clearance G2 between the lateral plate portion 50*a* of the second connection member 50 and the lower surface of the support plate 34.

The first connection member 49 and the second connection member 50 are formed of rigid material such as metal.

As shown in FIG. 4 to FIG. 6 and the like, the third bracket 37 is arranged between the first bracket 35 and the second bracket 36. In particular, the third bracket 37 is arranged in front of the second bracket 36 on the machine inward side and behind the inner bracket 35A of the first bracket 35.

The third bracket 37 includes a lateral plate portion 37*a* and a pair of longitudinal plate portions 37*b*. An upper surface of the lateral plate portion 37*a* is contacted to the lower surface of the support plate 34. The pair of longitudinal plate portions 37*b* each extend downward from both of corresponding one side edge of and the other side edge of the lateral plate portion 37*a*. The third bracket 37 extends toward a direction (the machine width direction) perpendicular to a direction of parallel alignment of the control valves V1 to V13.

As shown in FIG. 2 and FIG. 3, the third bracket 37 protrudes, from a right side edge of the support plate 34, an edge portion thereof disposed on the machine outward side (the right side). The edge portion of the third bracket 37 on the machine outward side is connected to a front upper plate 27G of the support base 27 by the bolt BL5. As shown in FIG. 8, a spacer 51 is inserted between the third bracket 37 and the front upper plate 27G.

As shown in FIG. 4 and FIG. 6, the edge portion of the third bracket 37, disposed on the machine inward side (the left side), is placed to the left of the second connection member 50 under the support plate 34. The edge portion is diagonally notched in approximately parallel to the second bracket 36. In this manner, the third bracket 37 does not block the arrangement of the pilot hoses H1 to H6, H8, H10, H12, H13, and HB3 in the space S.

As shown in FIG. 4 and FIG. 8, the third bracket 37 supports the valve unit VU at a portion near a center of the valve unit VU in the direction of parallel alignment of the valve unit VU, that is, a portion under the support plate 34 (an edge portion on the machine inward). In this manner, the valve unit VU is supported by the first bracket 35 at the front portion of the valve unit VU, is supported by the second bracket 36 at the rear portion of the valve unit VU, and is supported by the third bracket 37 at or near the center (at or near a center of gravity). When the valve unit VU is supported only at the front portion and the rear portion, the support plate 34 and the valve unit VU would be deformed at or near the center in the direction of parallel alignment, and thus the hydraulic fluid may leak. Prevention of the deformation requires a measure for increasing stiffness of the brackets requires, for example, increasing a plate thickness of the brackets. However, the increasing of the plate thicknesses of the brackets reduce the space S, and thus the arrangement of all of the pilot hoses will be hard in the reduced space S. On the contrary, in the embodiment, the valve unit VU is supported by the third bracket 37 at or near the center in the direction of parallel alignment, and thus the valve unit VU can be supported at or near the center of gravity in addition to the front portion and the rear portion, thereby the deformation can be prevented.

In particular, the third bracket 37 supports the second control valve V9 for dozer at a lower portion of the second control valve V9 for dozer, the second control valve V9 being included in the control valves V1 to V13 constituting the valve unit VU. Two dozer sections (the first control valve V13 for dozer and the second control valve V9 for dozer) in the valve unit VU distribute a signal outputted from a single of the pilot valve for dozer to two of the dozer sections V13 and V9, and thus it is not required to arrange two pilot hoses toward a side of the pilot valve for dozer. In this manner, as shown in FIG. 4, it is not required to arrange the pilot hose under the second control valve V9 for dozer disposed in the vicinity of the center of the valve unit VU, and thus the arrangement of the third bracket 37 does not block arrangement of the pilot hose. That is, the third bracket 37 is arranged on a position for supporting the valve unit VU at or near a portion under the second control valve V9 for dozer, and thereby the third bracket 37 prevents the deformation of the valve unit VU, being prevented from blocking the arrangement of the pilot hoses in the space S.

As shown in FIG. 8, a fourth bracket 38 is inserted between the valve unit VU and the first bracket 35. In particular, the fourth bracket 38 is inserted between: an upper surface of the first bracket 35; and lower surfaces of the control valve V1 for swing and of the first outlet block B1 in the front portion of the valve unit VU. As shown in FIG. 5 and FIG. 8, a spacer 52 having a cylindrical shape is inserted between the fourth bracket 38 and the first bracket 35.

Figure 9:
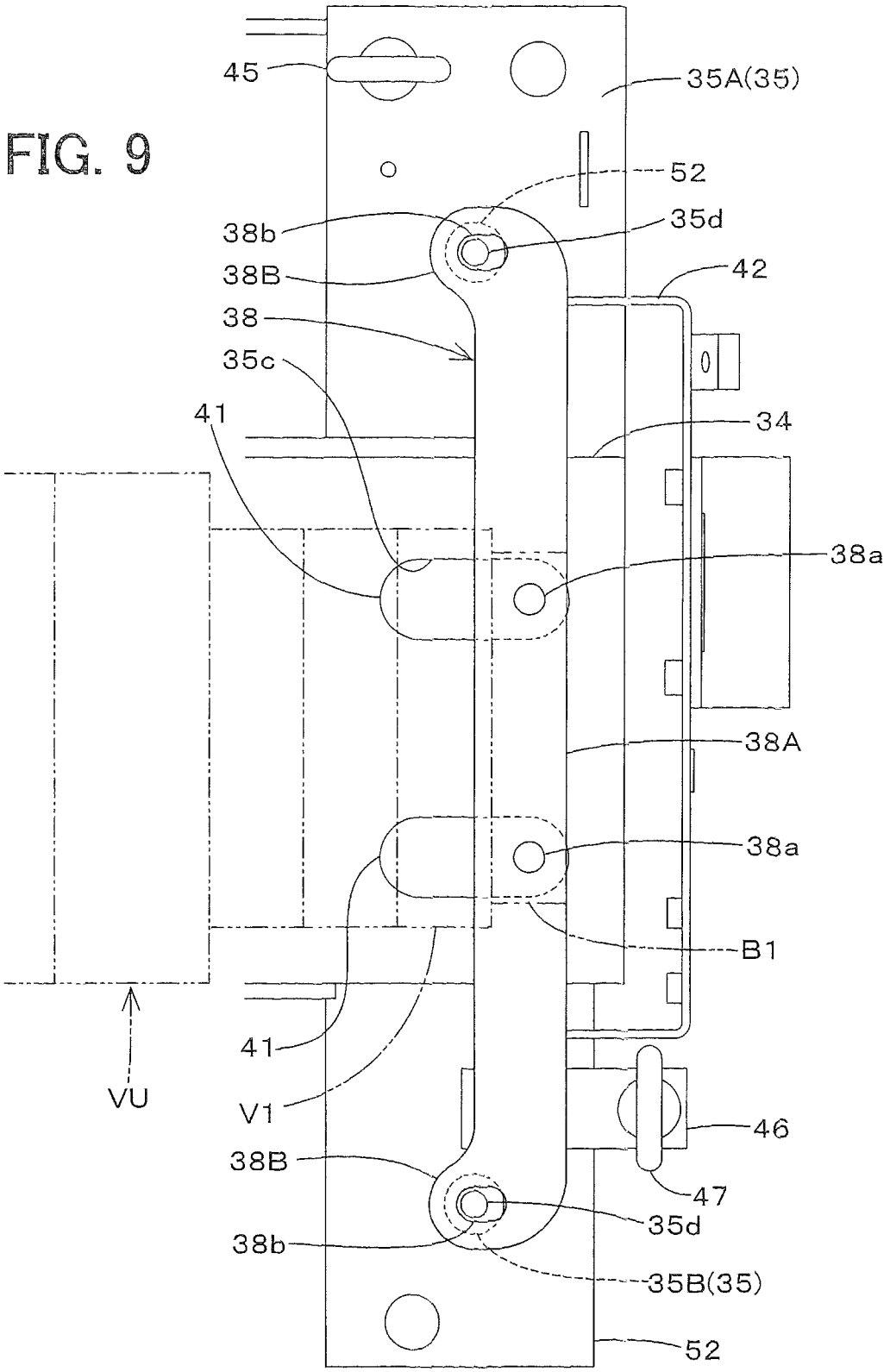
FIG. 9 is a plan view showing a way to attach a fourth bracket according to the first embodiment.

As shown in FIG. 9, the fourth bracket 38 is a member having an elongated flat plate shape, and includes a first attachment portion 38A and a pair of second attachment portions 38B. The first attachment portion 38A is attached to the valve unit VU. The second attachment portion 38B is attached to the first bracket 35.

The first attachment portion 38A extends toward the perpendicular direction (the machine width direction), and includes a pair of first attachment holes 38*a*. The pair of first attachment holes 38*a* each are circular holes for fixing the valve unit VU by using bolts, and are formed at an interval along the perpendicular direction.

The pair of second attachment portions 38B each extend from both of edge portions of the first attachment portion 38A toward the direction of parallel alignment. In addition, the pair of second attachment portions 38B each extend toward an identical direction (toward the front direction in FIG. 9). Each of the pair of second attachment portions 38B includes a second attachment hole 38*b* for attaching the valve unit VU to the first bracket 35. The second attachment hole 38*b* is configured of an elongate hole extending toward the direction of parallel alignment (toward the front to rear direction). The second attachment hole 38*b* and the first attachment hole 38*a* are arranged on positions not corresponding to each other in the direction of parallel alignment (toward the front to rear direction).

The valve unit VU is arranged on the fourth bracket 38, a bolt BL6 (refer to FIG. 4) is inserted to the first attachment hole 38*a* from below, and thus the fourth bracket 38 and the valve unit VU are fixed. The bolt BL6 can be inserted from below the support plate 34 by using the elongate hole 41, the elongate hole 35*c*, and the clearance G1. In addition, as shown in FIG. 9, a bolt insertion hole 35*d* is overlapped with the second attachment hole 38*b*, the bolt insertion hole 35*d* being formed in the first bracket 35 (the inner bracket 35A and the outer bracket 35B), a bolt is inserted to the second attachment hole 38*b* from above, and thereby the fourth bracket 38 and the first bracket 35 are fixed to each other.

The first bracket 35, the second bracket 36, the third bracket 37, and the fourth bracket 38 are formed of rigid material such as metal.

The valve unit VU varies the number of and a size of the section (the control valve) depending on the configuration of the working machine 1. The working machine 1 may employ three types of configurations, that is, the standard configuration, the two-piece configuration, and the A/D (Angle Dozer) configuration, and thus the valve unit VU varies the number of and a size of the section depending on each of the configurations.

Regarding the number of sections, the two-piece configuration and the A/D configuration employ additional one section in comparison with the standard configuration. In particular, the two-piece configuration additionally employs a control valve for controlling the second boom cylinder (the control valve V5 for two-piece configuration in the embodiment described above) in comparison with the standard configuration. The A/D configuration additionally employs a control valve for controlling the angle cylinder in comparison with the standard configuration.

Regarding a size of the section, the two-piece configuration employs the sections larger than the sections of the A/D configuration. In particular, the control valve for controlling the second boom cylinder is larger than the control valve for controlling the angle cylinder.

As described above, the number of and a size of the section of the valve unit VU vary depending on the configurations. For that reason, three types of the brackets are conventionally required to be prepared for the three configurations mentioned above, the bracket being inserted between the valve unit VU and the first bracket 35. On the contrary, in the embodiment, the employment of the fourth bracket 38 having the above-mentioned configuration enables the three configurations to be handled by one type of the bracket.

Figure 10:
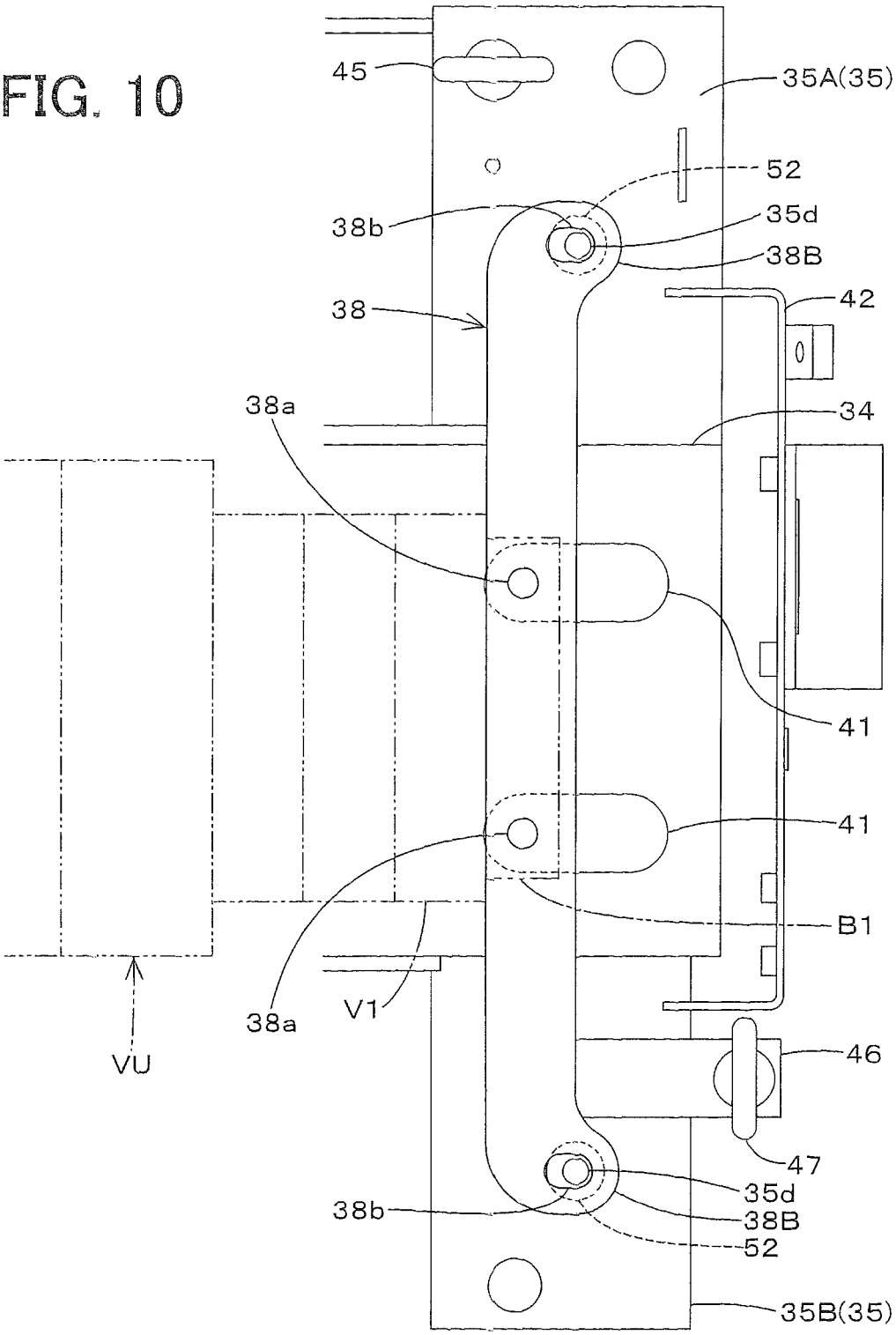
FIG. 10 is a plan view showing another way to attach the fourth bracket according to the first embodiment.

For the standard configuration, the second attachment portion 38B is arranged extending forward as shown in FIG. 10, and the second attachment hole 38*b* is positioned anterior to the first attachment hole 38*a*. In this manner, an attachment position (the first attachment hole 38*a*) to the valve unit VU is anterior to an attachment position (the second attachment hole 38*b*) to the first bracket 35.

For the two-piece configuration and the A/D configuration, the fourth bracket 8 shown in FIG. 10 is turned back as shown in FIG. 9, the second attachment portion 38B is arranged extending backward, and thus the second attachment hole 38*b* is positioned anterior to the first attachment hole 38*a*. In this manner, an attachment position (the first attachment hole 38*a*) to the valve unit VU is posterior to an attachment position (the second attachment hole 38*b*) to the first bracket 35. In this manner, the two-piece configuration and the A/D configuration can be handled, the two-piece configuration and the A/D configuration employing additional one section in comparison with the standard configuration.

A position of the fourth bracket 38 to the first bracket 35 is changed in the forward to rear direction, using the second attachment hole 38*b*, and thereby the two-piece configuration and the A/D configuration can be selectively handled. The second attachment hole 38*b* is an elongate hole extending along the front to rear direction, and thus a position of the bolt insertion hole 35*d* to the second attachment hole 38*b* can be moved in the front to rear direction.

In particular, as shown in FIG. 9, the bolt insertion hole 35*d* is positioned anterior to the second attachment hole 38 in handling the two-piece configuration. In handling the A/D configuration, the fourth bracket 38 shown in FIG. 9 is moved backward, and thus the bolt insertion hole 35*d* is positioned posterior to the second attachment hole 38*b*. The position of the fourth bracket 38 to the first bracket 35 is adjusted along the front to rear direction in the above-mentioned manner, and thus both of: the two-piece configuration having large sections; and the A/D configuration having small sections, each having the same number of sections, can be handled.

In addition, provision of the elongate hole 41, the elongate hole 35*c*, and the clearance G1 allows a bolt to be inserted into the first attachment hole 38*a* from below the support plate 34 even when the position of the fourth bracket 38 to the first bracket 35 is changed along the front to rear position.

A switch valve 60 is arranged above the valve unit VU, the switch valve 60 being configured to be connected to the control valves constituting the valve unit VU. The switch valve 60 is constituted of a three-way switch valve. The switch valve 60 includes an entrance port 61, a first exit port 62, a second exit port 63, and an operation handle 64. The switch valve 60 is configured to switch a supply target of the operation fluid to the first exit port 62 or to the second exit port 63 due to a switching operation of the operation handle 64, the operation fluid being introduced from the entrance port 61.

A return fluid tube (a return fluid path) 65 is connected to the entrance port 61. A first fluid tube 66 (a first fluid path) 66 is connected to the first exit port 62. A second fluid tube (a second fluid path) 67 is connected to the second exit port 63. In this manner, the switch valve 60 is configured to switch a connection target of the return fluid tube 65 to any one of the first fluid tube 66 and the second fluid tube 67.

The return fluid tube 65 serves as a fluid path for returning the operation fluid from the hydraulic device to the operation fluid tank 22, and includes a connection tool 65A, a tube joint 65B, and a hydraulic hose 65C. The connection tool 65A is connected to the entrance port 61 of the switch valve 60. The tube joint 65B connects the connection tool 65A and the hydraulic hose 65C to each other. The hydraulic hose 65C connects the tube joint 65B and the hydraulic device to each other.

The first fluid tube 66 is configured of a first tube member. The first tube member includes a first connection tool 66A, a connection tube 66B, and a tube joint 66C. The tube joint 66C and the connection tube 66B are arranged vertically extending center axes thereof. The first connection tool 66A is connected to the first exit port 62 of the switch valve 60. The tube joint 66C is connected to a lower portion of the first connection tool 66A at one end portion (an upper end portion) of the tube joint 66C, and is connected to one end portion (an upper end portion) of the connection tube 66B at the other end portion of the tube joint 66C. The connection tube 66B is connected to the other end portion (a lower end portion) of the tube joint 66C at one end portion (an upper end portion) of the connection tube 66B, and is connected, at the other end portion (a lower end portion) of the connection tube 66B, to an entrance port disposed on an upper portion of the control valve V8. The first connection tool 66A, the connection tube 66B, and the tube joint 66C each are formed of rigid material such as metal.

The second fluid tube 67 is configured of a second tube member. The second tube member includes a second connection tool 67A, a third connection tool 67B, and a pipe 67C. The second connection tool 67A is connected to the second exit port 63 of the switch valve 60. The third connection tool 67B is disposed on a fluid tube (a fluid path) returning from an exit port of the control valve V4 to the operation fluid tank 31. The pipe 67C connects the second connection tool 67A and the third connection tool 67B to each other. The second connection tool 67A, the third connection tool 67B, and the pipe 67C are formed of rigid material such as metal. The pipe 67C is formed to have an approximately L-shape, and includes: a horizontal portion extending from the second connection tool 67A toward the machine inward side; and a vertical portion bending and extending downward from the horizontal portion to the third connection tool 67B.

The third connection tool 67B is connected to an exit port of the control valve V4 by the first connection tube 68, the tube joint 69, the second connection tube 70, and the connection tool 71. The first connection tube 68 is connected to the exit port of the connection valve V4 at one end portion of the first connection tube 68, and is connected to the tube joint 69 at the other end portion of the first connection tube 68. The tube joint 69 connects the other end portion of the first connection tube 68 to the connection tool 71. The second connection tube 70 is connected to the connection tube 71 at one end portion of the second connection tube 70, and is connected to the third connection tool 67B at the other end portion of the second connection tube 70.

A hydraulic hose 73 is connected to the third connection tool 67B by the tube joint 72. The hydraulic hose 73 is connected to the operation fluid tank 22. When the switch valve 60 connects the return fluid tube 65 and the second fluid tube 67 to each other, the operation fluid passing through the return fluid tube 65 enters the hydraulic hose 73 through the second fluid tube 67 without entering the valve unit VU, and thus returns to the operation fluid tank 22. When the switch valve 60 connects the return fluid tube 65 and the first fluid tube 66 to each other, the operation fluid passing through the return fluid tube 65 enters en entrance port of the control valve V8.

The switch valve 60 is supported above the valve unit VU by the first tube member forming the first fluid tube 66. The first tube members (the first connection tool 66A, the connection tube 66B, and the tube joint 66C) forming the first fluid tube 66 are formed of rigid material, and thus the first tube members can support the switch valve 60 above the control valve constituting the valve unit VU (above the control valve V8 in the embodiment) without using a special support member. In addition, the second tube members (the second connection tool 67A, the third connection tool 67B, and the pipe 67C) forming the second fluid tube 67 are also formed of rigid material, and thus the second tube members can support the switch valve 60 above the valve unit VU together with the first tube members forming the first fluid tube 66.

Figure 13:
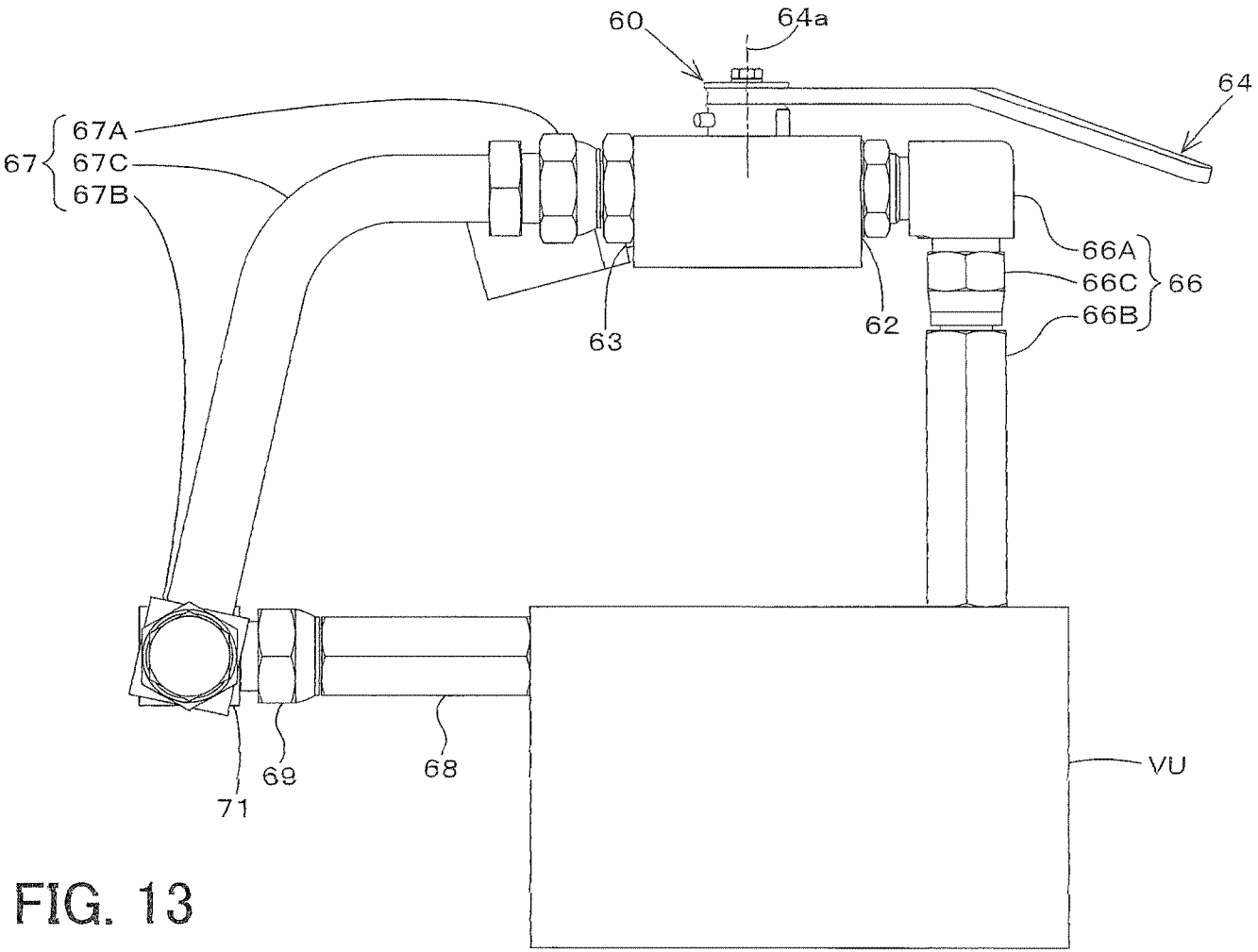
FIG. 13 is a back view showing the area near the switch valve according to the first embodiment.

As shown in FIG. 13, a revolution shaft 64*a* of the operation handle 64 of the switch valve 60 is vertically arranged.

When the revolution shaft 64*a* of the operation handle 64 of the switch valve 60 is horizontally arranged (refer to FIG. 1 of Japanese Unexamined Patent Application Publication No. 2014-198936, for example), a force to switch the switch valve (a force required to switch) has to be large in order to prevent the switch valve from being switched due to an own weight of the operation handle. For that reason, an operator has to apply a large force to an operation of the switching. On the contrary, in the embodiment, the revolution shaft 64*a* of the operation handle 64 of the switch valve 60 is vertically arranged, and accordingly the own weight of the operation handle does not switch the switch valve. Thus, a force to switch the switch valve is not required to be large, and thereby an operator can easily operate the switching.

In addition, when the revolution shaft 64*a* of the operation handle 64 of the switch valve 60 is vertically arranged, an operational direction of the operation handle 64 is identical to a direction of screwing of the tube joint 66B, and thus the screwing of the tube joint 66B may be loosened due to the operation (revolution) of the operation handle 64. However, in the embodiment, since the second tube member (in particular, the pipe 67C) constituting the second fluid tube 67 is formed of rigid material, the revolution of the operation handle 64 is not transferred to the tube joint 66B when the operation handle 64 is revolved, and thereby the screwing of the tube joint 66B is not loosened.

The upper portion of the switch valve 60 can be covered with an upper cover (not shown in the drawings). In that case, when the revolution shaft 64*a* of the operation handle 64 is horizontally arranged, the operation handle 64 may contact to the upper cover. Accordingly, the operation handle 64 has to be short in order to prevent the contact, and thus requires a large force for operating the operation handle 64. On the contrary, in the embodiment, since the revolution shaft 64*a* of the operation handle 64 of the switch valve 60 is vertically arranged, the operation handle 64 can be prevented from contacting to the upper cover, and a length of the operation handle 64 can be ensured to obtain a sufficient operation force. In addition, as shown in FIG. 13, a tip end portion of the operation handle 64 is tilted downward, and thereby both of: the prevention of contacting to the upper cover; and the ensuring of the length of the operation handle 64 are achieved more certainly.

Second Embodiment

Figure 14:
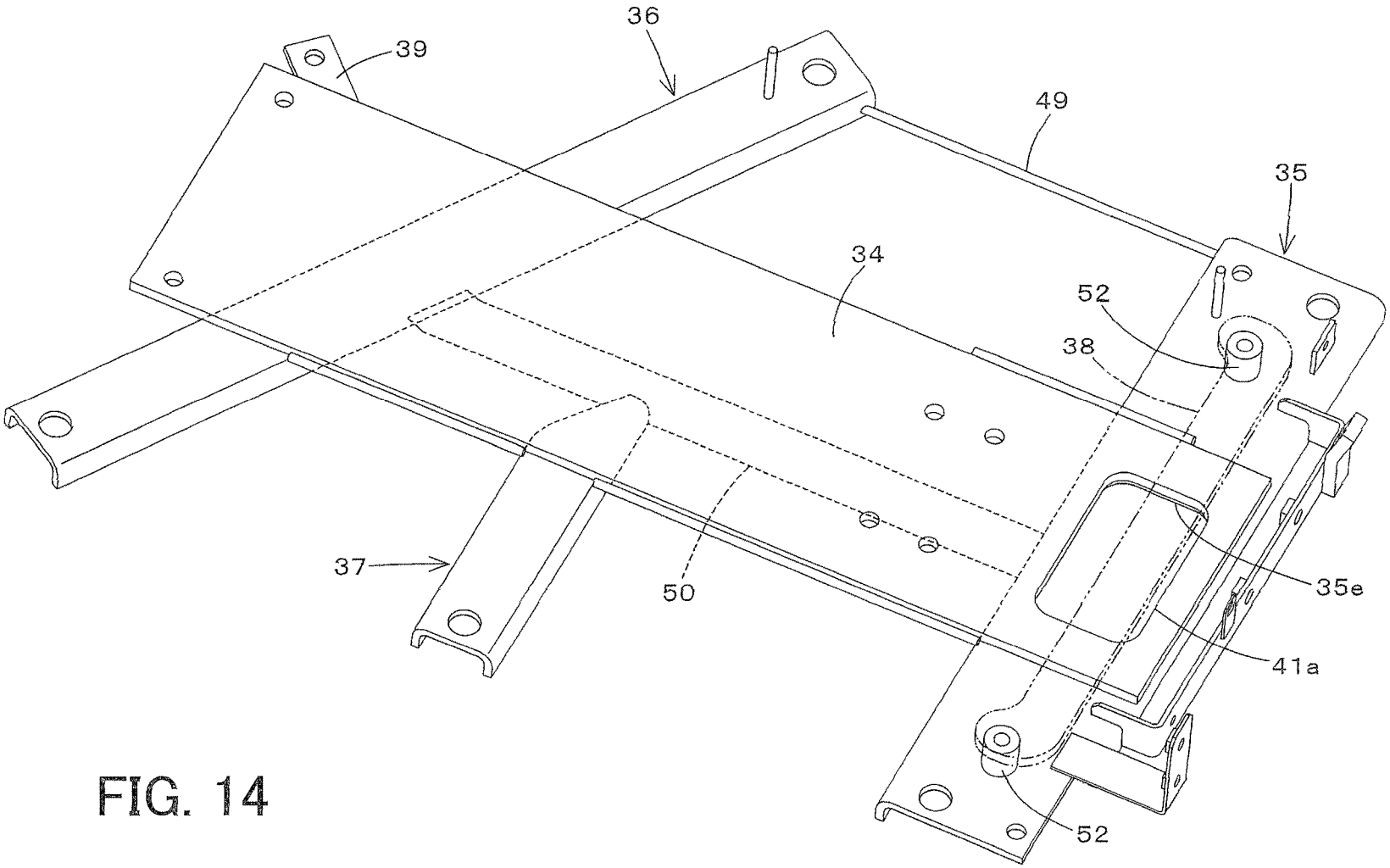
FIG. 14 is an upward perspective view showing a support structure for a valve unit according to a second embodiment.
Figure 15:
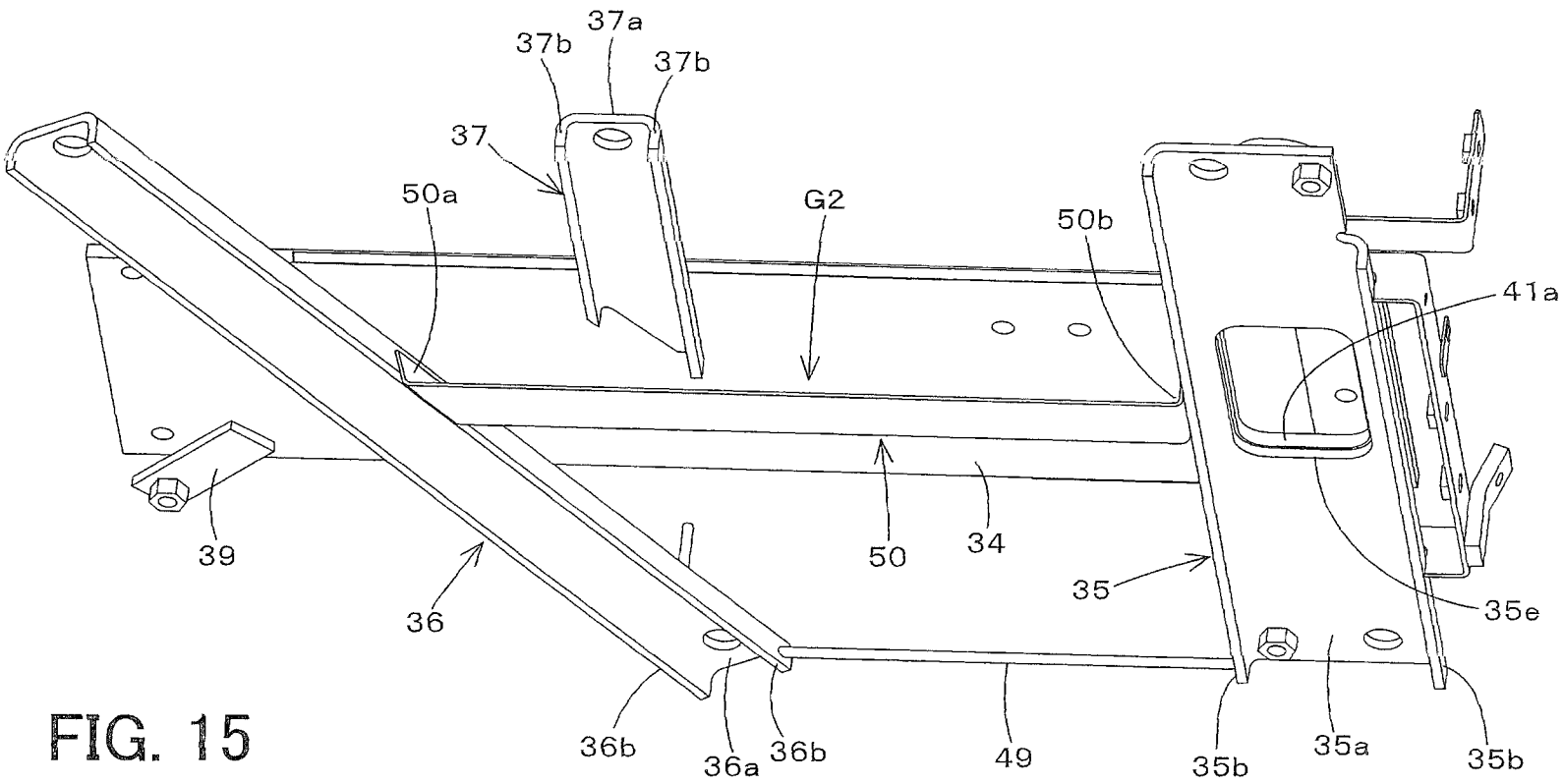
FIG. 15 is a downward perspective view showing the support structure for the valve unit according to the second embodiment.

FIG. 14 and FIG. 15 show a second embodiment of the present invention. Main technical points of the second embodiment modified from the above-mentioned embodiment will be explained below. The identical reference numerals are given to configurations similar to the configurations of the embodiment described above, and thus the explanations thereof will be omitted.

In the second embodiment, the first bracket 35 is formed of a single member. That is, the first bracket 35 employs a configuration integrating the inner bracket 35A and the outer bracket 35B, the inner bracket 35A and the outer bracket 35B being described in the above-mentioned embodiment (refer to FIG. 5 and FIG. 6). The first bracket 35 is disposed extending along a direction (the machine width direction) perpendicular to the direction of parallel alignment of the control valves V1 to V13.

The first bracket 35 protrudes, from a right side edge of the support plate 34, an edge portion thereof disposed on the machine outward side, and protrudes, from a left side edge of the support plate 34, an edge portion thereof disposed on the machine inward side. The edge portion of the first bracket 35, disposed on the machine outward side, is coupled to the front upper plate 27F of the support base 27. The edge portion of the first bracket 35, disposed on the machine inward side, is coupled to the support bracket 13.

A hole for attachment of a hanging metal tool is disposed on each of: the edge portion of the first bracket 35, disposed on the machine inward side; and the edge portion of the first bracket 35, disposed on the machine outward side. In this manner, both of the edge portions of the first bracket 35 are configured to allow attachment of the hanging metal tools, and thereby omitting the second plate 46 for attachment of the hanging metal tool described in the above-mentioned embodiment. In addition, a hanging metal tool is attached to the first bracket 35 having a high stiffness also on the machine outward side, and thus the attachment portions for the hanging metal tools can be certainly prevented from being broken in hanging up the valve unit VU, a heavy unit.

Moreover, in the first embodiment described above, the elongate hole 35*c* is formed on the inner bracket 35A; however, in the second embodiment, a rectangular hole 35*e* is formed instead of the elongate hole 35*c*. Furthermore, in the first embodiment described above, the pair of the elongate holes 41 is formed on the support plate 34; however, in the second embodiment, a single of rectangular hole 41*a* is formed instead of the pair of elongate holes 41. The rectangular hole 35*e* and the rectangular hole 41*a* are disposed on a position where the rectangular hole 35*e* and the rectangular hole 41*a* are overlapped with each other, and are positioned under the first attachment hole 38*a* of the fourth bracket 38.

In the above description, the embodiments of the present invention has been explained. However, all the features of the embodiments disclosed in this application should be considered just as examples, and the embodiments do not restrict the present invention accordingly. A scope of the present invention is shown not in the above-described embodiments but in claims, and is intended to include all modifications within and equivalent to a scope of the claims.

What is claimed is:

1. A working machine comprising:

a machine body;

an operation fluid tank mounted on the machine body;

a plurality of hydraulic devices to be operated by an operation fluid supplied from the operation fluid tank;

a valve unit including a plurality of control valves to control the hydraulic devices, the control valves being arranged along a horizontal direction;

a switch valve to be connected to the control valves; and a first tube member including a first fluid tube to connect one of the control valves and the switch valve to each other and supporting the switch valve above the control valve connected to the switch valve, the first tube member being formed of a rigid member, the rigid member standing upward from the control valve connected to the switch valve, and the rigid member is connected to an upper portion of the control valve and extends from the upper portion to the switch valve to support the switch valve from below without using a bracket support member.

2. The working machine according to claim 1, comprising:

a return fluid tube configured to supply the operation fluid returned from the hydraulic device; and a second fluid tube configured to connect the switch valve and the operation fluid tank to each other, wherein the switch valve includes:

an entrance port configured to be connected to the return fluid tube;

a first exit port configured to be connected to the first fluid tube; and a second exit port configured to be connected to the second fluid tube, the switch valve being configured to switch a connection target of the return fluid tube to any one of the first fluid tube and the second fluid tube.

3. The working machine according to claim 2, wherein the first tube member includes:

a first connection tool disposed on the first exit port;

a connection tube disposed on an entrance port of the control valve; and a tube joint configured to connect the first connection tool and the connection tube to each other.

4. The working machine according to claim 2, comprising:

a second tube member forming the second fluid tube and being formed of another rigid member, the second tube member including:

a second connection tool disposed on the second exit port;

a third connection tool disposed on a fluid tube returning from the control valve to the operation fluid tank; and a pipe configured to connect the second connection tool and the third connection tool to each other.

5. The working machine according to claim 1, wherein a revolution axis of an operation handle of the switch valve is arranged along a vertical direction.

6. The working machine according to claim 1, wherein the switch valve and the control valve connected to the switch valve are overlapped with each other in a plan view.

7. The working machine according to claim 1, wherein the rigid member is mounted to a top surface of the control valve.

8. A working machine comprising:

a machine body;

an operation fluid tank disposed on the machine body;

a plurality of hydraulic devices to be operated by an operation fluid supplied from the operation fluid tank;

a valve unit including:

a plurality of control valves to control the operation of the hydraulic devices, the control valves being arranged in parallel along a horizontal direction;

a hydraulic tube to be connected to the control valves;

a first bracket arranged on one side of the control valves along a direction of parallel alignment of the control valves, the first bracket being configured to form:

a space for arranging the hydraulic tube under the control valves; and a second bracket arranged on the other side of the control valves along the direction of parallel alignment of the control valves, the second bracket being configured to form the space together with the first bracket and being arranged diagonally to the first bracket, wherein the first bracket and the second bracket support the valve unit, and wherein the hydraulic tube extends under the control valve from one side toward the other side in a direction intersecting the direction of parallel alignment, and is connected to at least one of connection portions of the control valves, the connection portions being disposed on the other side.

9. The working machine according to claim 8, wherein the valve unit is disposed on one side of the machine body in a width direction, and a width of the space on an inner side in the width direction of the machine body is wider than a width of the space on an outer side in the width direction, the widths being formed by the first bracket and the second bracket.

10. The working machine according to claim 8, wherein the first bracket is provided with a hanging metal tool.

11. The working machine according to claim 8, comprising:

an engine arranged on the machine body; and a fuel tank configured to store fuel supplied to the engine, wherein the first bracket has a space below the control valve and above the fuel tank, the space allowing the hydraulic tube to pass through the space, and wherein the first bracket and the second bracket support the valve unit above the fluid tank.

12. The working machine according to claim 8, comprising a battery disposed on the machine body, wherein the first bracket has a space below the control valve and above the battery, the space allowing the hydraulic tube to pass through the space, and wherein the first bracket and the second bracket support the valve unit above the battery.

13. The working machine according to claim 8, wherein the operation fluid tank has:

a main body portion; and an extension portion extending forward from a lower portion of the main body portion, wherein the first bracket has a space below the control valve and above the extension portion, the space allowing the hydraulic tube to pass through the space, and wherein the first bracket and the second bracket support the valve unit above the extension portion.

14. A working machine comprising:

a machine body;

an operation fluid tank disposed on the machine body;

a plurality of hydraulic devices to be operated by an operation fluid supplied from the operation fluid tank;

a valve unit including:

a plurality of control valves to control the operation of the hydraulic devices, the control valves being arranged in parallel along a horizontal direction;

a hydraulic tube to be connected to the control valves;

a first bracket arranged on one side of the control valves along a direction of parallel alignment of the control valves, the first bracket being configured to form:

a space for arranging the hydraulic tube under the control valves;

a second bracket arranged on the other side of the control valves along the direction of parallel alignment of the control valves, the second bracket being configured to form the space together with the first bracket and being arranged diagonally to the first bracket; and a third bracket arranged between the first bracket and the second bracket, the third bracket being configured to support the valve unit at or near a center in the direction of parallel alignment.

15. The working machine according to claim 14, wherein the plurality of control valves include at least two dozer control valves, and one of the dozer control valves is arranged at or near the center of the valve unit in the direction of parallel alignment.

16. The working machine according to claim 15, comprising:

a fourth bracket inserted between the valve unit and the first bracket, wherein the fourth bracket includes:

a first attachment hole for attachment of the valve unit; and a second attachment hole for attachment of the first bracket, and the first attachment hole and the second attachment hole are arranged on positions not corresponding to each other in the direction of parallel alignment.

17. The working machine according to claim 16, wherein the second attachment hole is configured of an elongate hole extending in the direction of parallel alignment.

* * * * *